United States Patent [19]

Eaton

[11] Patent Number: 4,757,606

[45] Date of Patent: Jul. 19, 1988

[54] METHOD AND APPARATUS FOR TERMINAL INSERTION

[75] Inventor: Homer L. Eaton, Leucadia, Calif.

[73] Assignee: MTS Vektronics Corporation, Carlsbad, Calif.

[21] Appl. No.: 9,274

[22] Filed: Jan. 28, 1987

Related U.S. Application Data

[62] Division of Ser. No. 646,949, Sep. 4, 1984, Pat. No. 4,658,503.

[51] Int. Cl.[4] ..... H01R 43/00

[52] U.S. Cl. ..... 29/748; 29/742; 29/754

[58] Field of Search ..... 29/854, 855, 857, 868, 29/869, 872, 747, 748, 750, 752, 754, 758, 837, 845, 876, 881, 882, 884, 271, 272, 742, 842

[56] References Cited

U.S. PATENT DOCUMENTS

| | | | |
|---|---|---|---|
| T101,002 | 9/1981 | Ellington, III | 29/747 |
| 3,023,789 | 3/1962 | Bonhomme | 140/93 |
| 3,103,735 | 9/1963 | Bos et al. | 29/33 |
| 3,136,040 | 6/1964 | Bauer et al. | 29/203 |
| 3,185,183 | 5/1965 | Loy | 140/71 |
| 3,329,002 | 7/1967 | Schwalm | 72/146 |
| 3,513,526 | 5/1970 | Eastin | 29/203 |
| 3,605,234 | 9/1971 | Bogursky | 29/203 H |
| 3,789,484 | 2/1974 | Morgan | 29/203 H |
| 3,811,168 | 5/1974 | Anderson et al. | 29/203 H |
| 3,964,147 | 6/1976 | Fusco et al. | 29/203 |
| 4,043,034 | 8/1977 | Sucheski et al. | 29/749 |
| 4,055,889 | 11/1977 | Fusco et al. | 29/710 |
| 4,074,424 | 2/1978 | Deshich et al. | 29/753 |
| 4,087,908 | 5/1978 | Fusco et al. | 29/753 |
| 4,089,405 | 5/1978 | Loomis et al. | 198/475 |
| 4,099,663 | 7/1978 | Brill et al. | 228/159 |
| 4,164,065 | 8/1979 | Funcik et al. | 29/564 |
| 4,171,566 | 10/1979 | Tominoi | 29/748 |
| 4,247,980 | 2/1981 | Tominoi | 29/742 |
| 4,308,659 | 1/1982 | Brandewie et al. | 29/748 |
| 4,341,014 | 7/1982 | Loy et al. | 29/857 |
| 4,351,109 | 9/1982 | Kelly et al. | 29/747 |
| 4,395,818 | 8/1983 | Jackson | 29/747 |
| 4,404,743 | 9/1983 | Brandewie et al. | 29/857 |

FOREIGN PATENT DOCUMENTS

| | | | |
|---|---|---|---|
| 962044 | 2/1975 | Canada | 26/37 |

*Primary Examiner*—Mark Rosenbaum
*Assistant Examiner*—Joseph M. Gorski
*Attorney, Agent, or Firm*—Gausewitz, Carr & Rothenberg

[57] ABSTRACT

A movable working head carries a pair of drive rollers, an insertion quill, and a routing nozzle that are manipulated so that a first terminal on one end of a wire is grasped between the rollers and inserted into the quill which is then inserted partly into a connector aperture. The rollers are rotated to drive the wire and terminal through the quill into an engaged position within the connector, terminal insertion is tested, and the insertion quill is replaced with the routing nozzle so that the working head can traverse a harness routing path with the rollers and nozzle sliding freely along the length of the wire towards its other end. Near the second end of the wire, the rollers grasp the second terminal pin, rotate with the pin 180° about an axis parallel to the roller axes and are moved to insert this terminal pin into the insertion quill so that the working head may move the quill and rollers to a second connector.

43 Claims, 10 Drawing Sheets

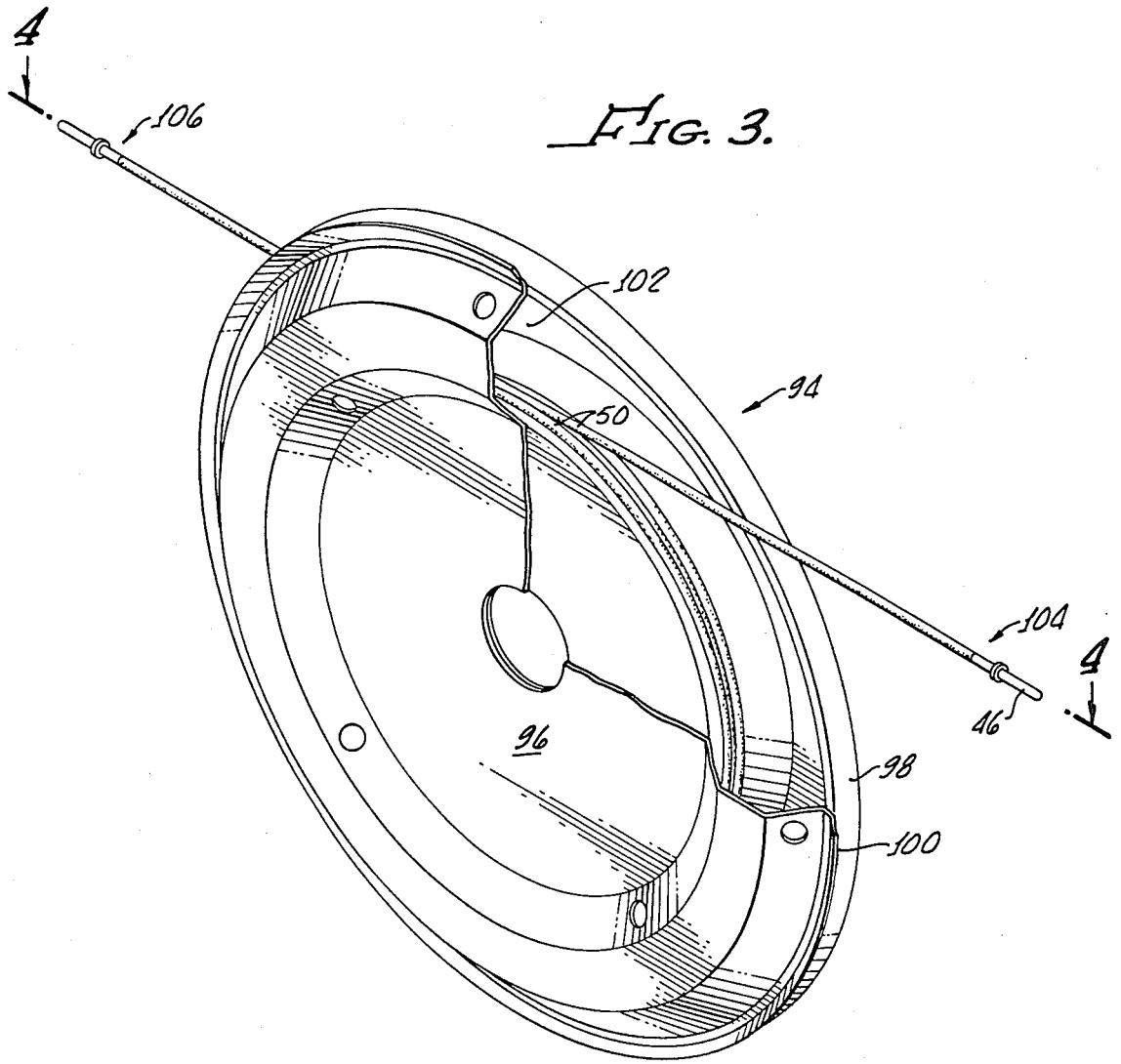
FIG. 3.
FIG. 4.
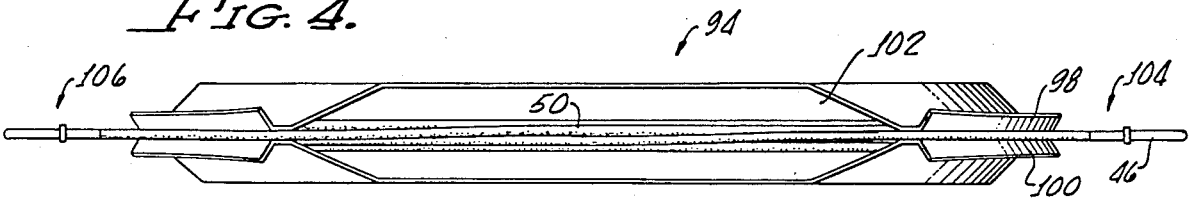

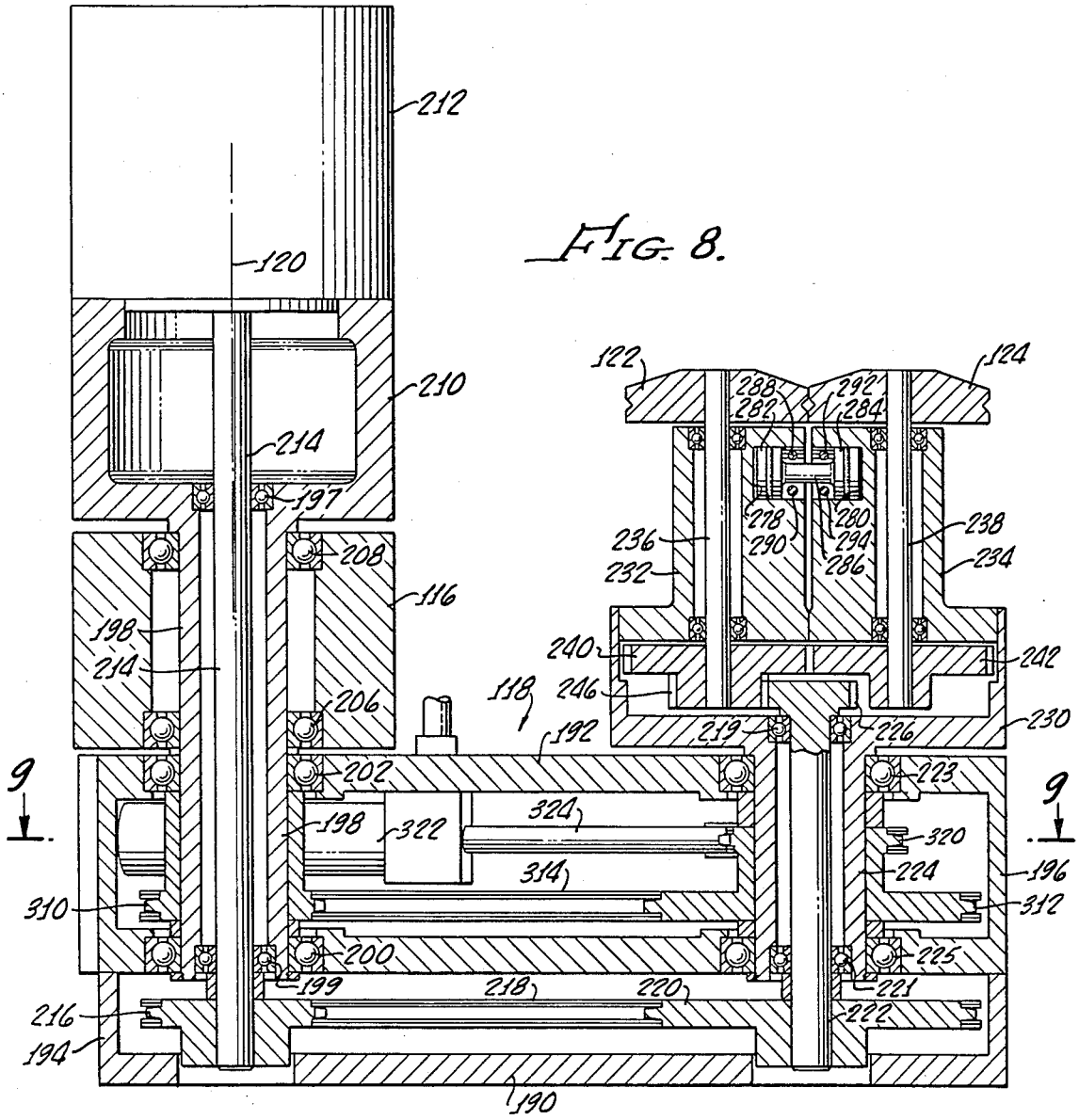
FIG. 8.
FIG. 9.
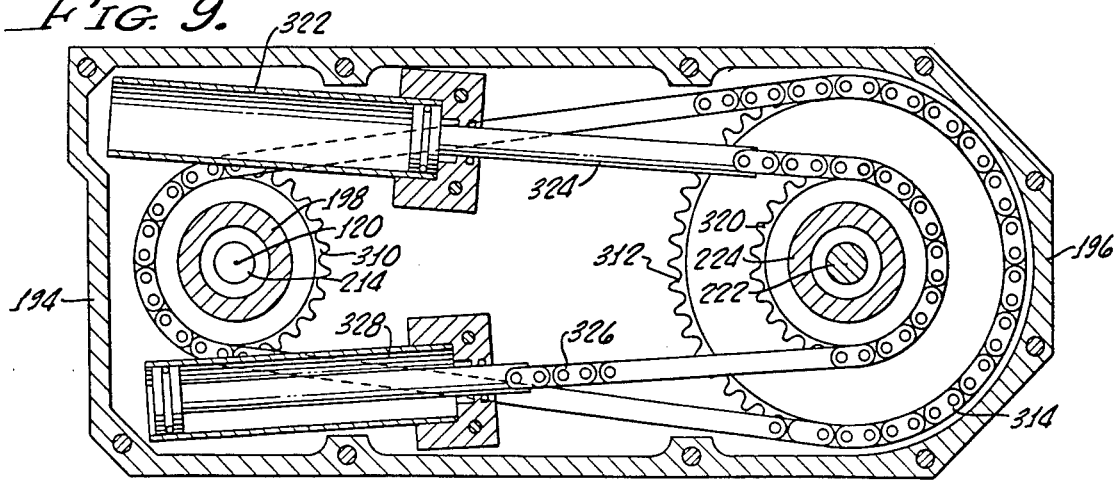

METHOD AND APPARATUS FOR TERMINAL INSERTION

This is a division of application Ser. No. 646,949, filed Sept. 4, 1984, now U.S. Pat. No. 4,658,503, for Method and Apparatus for Terminal Insertion.

BACKGROUND OF THE INVENTION

The present invention relates to methods and apparatus for assembly of a harness of wires and connectors, and more particularly concerns machine insertion of terminal pins on one or both ends of a wire into one or more multiple pin connectors and routing the wire between the connectors in a desired path.

Electrical wire harnesses embody a number of wires, each having a terminal pin affixed to one or both of its ends. The wires are connected to and between different pairs of multiple pin connectors. Optical fibers, carrying optical signals, and having much greater information carrying capacity, are replacing electrical conductors. Such optical conductors are assembled and connected in arrangements similar to those employed for electrical conductors. Accordingly, the term "wire", as used throughout the description and claims, shall denote either electrical or optical energy conductors.

Many machines devised for automatic assembly of wire harnesses use devices for gripping a wire terminal pin, in a manner similar to manual pin insertion methods, and for moving the pin into the connector while it is so held. Such devices fail to protect the terminal pin during handling, are capable of handling only one end of the wire at a time and must be released from and caused to regrasp the other end of the wire for completion of connection of a single wire that has a pin at both ends.

Many multiple pin connectors have an exceedingly high density of connector apertures, each of which receives a thin delicate terminal pin. A single connector may have as many as 100 or more wires connected to it. After many of the wires have been connected to the connector, the next terminal pin to be inserted must be forced between closely packed wires that have been previously connected. Further, the pin is easily damaged if not precisely registered with the connector aperture. Thus, some means to protect the long slender pin during the insertion process is required.

The Brandewie et al U.S. Pat. No. 4,308,659, describes an attempt to handle assembly of wires with multiple pin connectors by employing a wire guide tunnel positioned at the connector. A wire is laterally delivered to the tunnel, and both the wire and terminal pin are driven through the tunnel into the connector. The patent to Brandewie et al, with its guide tunnel fixedly positioned relative to the connector, requires ejector arms to displace previously connected wires. This apparatus is capable of handling only one end of a wire at one time. It grasps the wire, but not the pin, and thus cannot maneuver the pin conveniently and accurately. An entirely new machine set up must be accomplished for connection of the second ends of the terminal fitted wires. Moreover, the connector in the system of this patented device is moved to be positioned with respect to a fixed wire and terminal feed path. This movement of the connector requires movement of the entire bundle of previously connected wires.

No provision is made in prior art for possible misalignment of the connector aperture with the wire feed path, nor for possible misalignment of apertures of the resilient connector grommet with the connector apertures or with the wire feed path. A multiple pin connector frequently has a resilient wire receiving grommet having a number of apertures, each of which is nominally aligned with an individual one of the terminal receiving apertures of the connector. In the course of insertion of many wires through the grommet into the connector apertures, the grommet may become displaced or distorted so that its remaining apertures are no longer in registry with the connector apertures. The long, slender and delicate terminal pin cannot correct such misalignment during insertion and is likely to be bent upon attempted insertion through a misaligned grommet aperture.

Despite the fact that many harnesses have connectors attached to both ends of the wires, systems for accomplishing machine controlled routing of a wire and protected insertion of both wire ends in connectors are not known in the prior art.

Accordingly, it is an object of the present invention to provide a terminal insertion system that avoids or minimizes above-mentioned limitations.

SUMMARY OF THE INVENTION

In carrying out principles of the present invention, in accordance with a preferred embodiment thereof, a terminal pin of a wire is grasped between a pair of drive rollers and moved to insert the pin into the bore of a protective quill. The rollers and quill are moved together to insert the quill partly into a connector, thereby to correct any possible misalignment of a grommet aperture, and the rollers are rotated to drive the wire and the pin through the quill into the connector. The combination of rollers and quill is retracted from the connector, the quill is replaced with a routing nozzle, and the rollers and nozzle are traversed along a desired wire harness route, with the wire being guided by the nozzle and sliding between but still retained by the rollers, to enable the rollers to reach the other end of the wire and grasp the second terminal pin on the second wire end. The rollers and second terminal pin are rotated about an axis parallel to the roller axes and the second pin is inserted into the insertion quill, whereby the second terminal pin, rollers and insertion quill, may be moved as a unit and the rollers driven to insert the second pin into a second connector.

BRIEF DESCRIPTION OF THE DRAWINGS

FIG. 3 is a perspective view, with parts broken away, of an exemplary reel for holding wire to be assembled in a wire harness;

FIG. 4 is a sectional view taken on lines 4—4 of the reel of FIG. 3;

FIG. 8 is a sectional view of the swing arm and pinch rollers of the working head;

FIG. 9 is a section taken on lines 9—9 of FIG. 8;

DETAILED DESCRIPTION OF THE INVENTION

Figure 1:
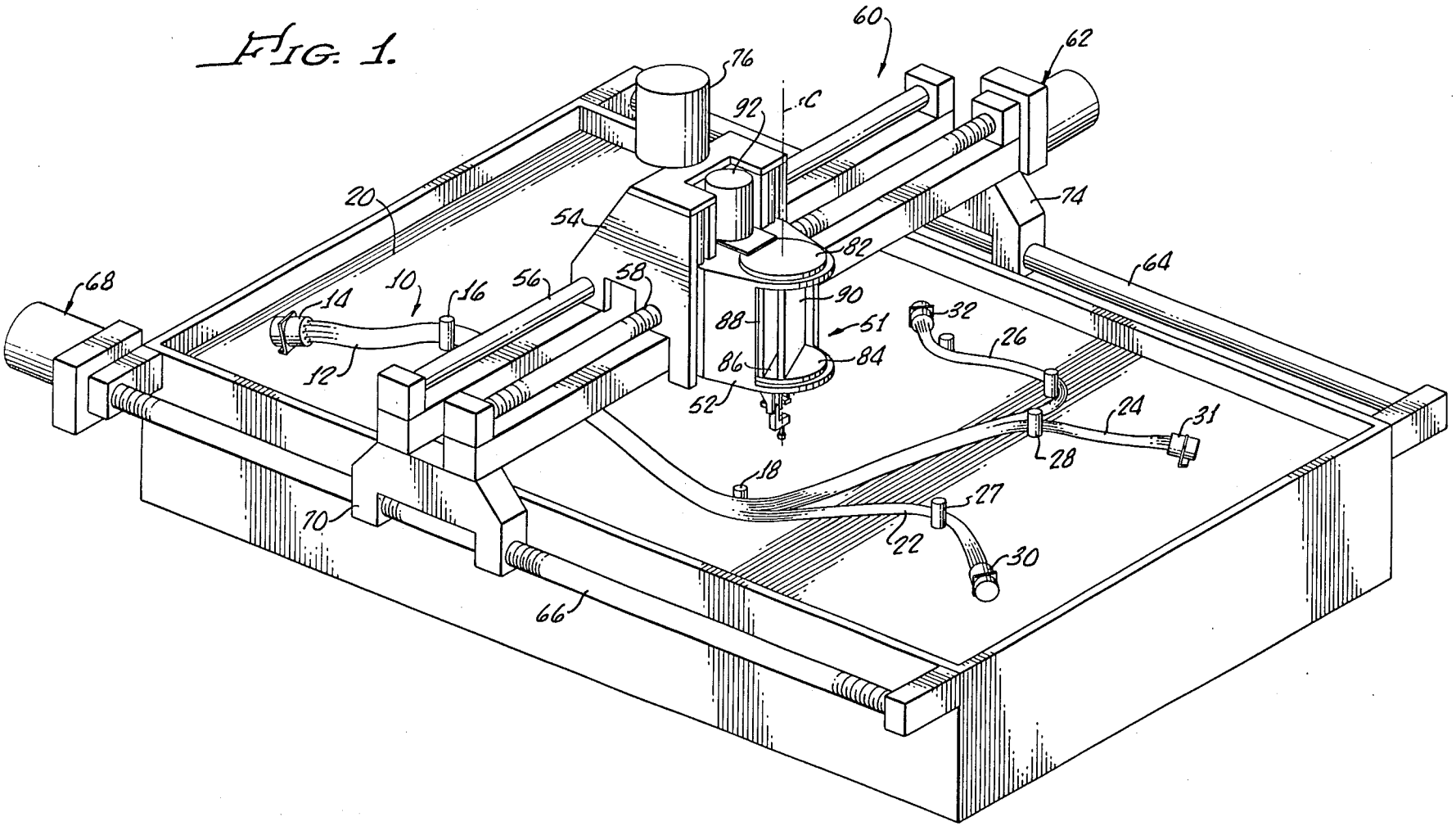
FIG. 1 is a perspective illustration of a harness assembly table and gantry system embodying principles of the present invention.

The function of the method and apparatus described herein is to assemble a harness of electrical wires of the type generally indicated by the exemplary configuration of harness 10 shown in FIG. 1. The harness, as shown solely for purposes of exposition, includes a harness trunk or main branch 12 comprised of a number of individual wires each of which has a terminal pin secured to each end. Each pin on one end of the wires is inserted into an individual one of a plurality of apertures in a high density, multi-pin connector 14. The trunk 12 of the illustrated harness is routed around a plurality of upstanding guide pins 16, 18, projecting upwardly from the surface of a table 20 upon which the harness is to be assembled. The harness trunk may divide into a number of secondary branches, such as those indicated at 22, 24, 26, which are routed around additional guide posts, such as those indicated at 27, 28 and 29, to additional connectors, such as connectors 30, 31 and 32, all mounted on the assembly table 20.

Figure 2:
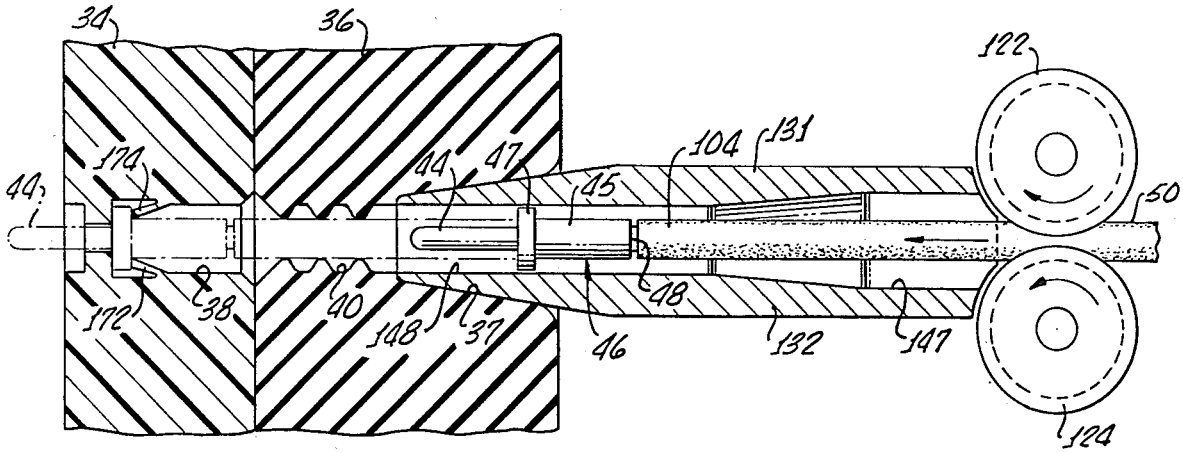
FIG. 2 is a fragmentary sectional view showing, on an enlarged scale, the insertion of a terminal pin and protective quill into a connector.

Illustrated in FIG. 2 is a portion of a typical connector, such as connector 14, having a retainer plate 34 and a resilient grommet 36 each having apertures 38, 40, respectively, that are nominally in mutual alignment so as to receive the long, slender, thin and delicate shaft 44 of a terminal pin generally indicated at 46. The rear section 45 of the terminal pin is separated from shaft 44 by an enlarged shoulder 47 and is crimped or otherwise conveniently secured to the stripped end 48 of an insulated wire 50 of which a large number collectively form the harness 10. The other end of wire 50 is also stripped and connected to an identical terminal pin (not shown in FIG. 2). It will be understood, of course, that such a connector and grommet have many pin receiving apertures, all identical to apertures 38, 40, which are closely spaced so that as many as one hundred or more wires protruding from the face of the connector and from the grommet will be very closely packed one against the other, providing an exceedingly dense and tight bundle of wires.

In assembly of the harness, according to principles of the present invention, a single wire has its first end terminal pin inserted into one connector, such as connector 14, for example, and, after positioning the wire along the desired harness path, has its second end terminal pin inserted into a second connector, such as one of the connectors 30, 31, and 32, for example. Thereafter, a second wire has its ends inserted into its appropriate connectors, to be followed by connection and routing of the third, fourth and subsequent wires. Thus, instead of connecting a first end of each of a large group of wires to a single connector as a first step and thereafter attempting to sort, separate and locate the second ends of individual ones of previously connected wires for connection into the other connectors, each wire, according to one aspect of the present invention, has both of its ends inserted before assembly of a second wire into the harness is begun. The machine that connects and routes also carries the wire to which terminals have been connected at both ends.

The wire is carried and stored on a machine working head 51 carried on a carriage block 52 (FIG. 1). Carriage block 52 is mounted for vertical sliding motion on a carriage 54, which, in turn, is mounted for motion transversely of table 20 on a gantry 60, including a pair of transverse guides 56, 58, along which it is driven by a motor and gear box 62. Various mechanisms are known for driving such a carriage, such as a screw thread formed on guide 58 engaged with a nut (not shown) carried by the carriage 54. Gantry 60 is itself mounted for motion along the length of the table 20 on longitudinally extending lateral guides 64, 66 of which guide 66 is a screw driven by a motor and gear box 68 and cooperating with a nut (not shown) carried in a gantry leg 70. If deemed necessary or desirable, a similar drive, including a nut in leg 74, on the other side of the gantry, may be provided.

Carriage block 52 is mounted to carriage 54 for vertical motion (assuming for purposes of exposition that table 20 and the various gantry and carriage guides are horizontal) under control of a Z axis motor 76, whereby the carriage block can be positioned at any point in an X, Y, Z Cartesian coordinate system defined by the directions of the three linear motions of the carriage block. Mounted on the vertically slidable carriage block 52, for rotation about a vertical axis C that is parallel to the Z axis of the system, is the working or insertion and routing head 51 which is formed of upper and lower circular rotary plates 82, 84. A wire reel receiving magazine 86 is defined between fixed, mutually spaced upstanding sidewalls 88, 90 which fixedly interconnect plates 82, 84. The working head is rotated about the C axis by a motor 92 carried by the carriage block.

Although the carriage and working head may carry a length of wire in many different configurations, it is found most convenient and most efficient, for all but very short lengths of wire, to mount the wire (having each end stripped and connected to a terminal pin) on a reel 94, such as shown in FIGS. 3 and 4. The reel includes a central hub 96 and outwardly flaring resilient lips 98 and 100 defining between the lips and the hub a wire receiving cavity 102 upon which is wound a wire, which may be up to a hundred feet or more in length. The wire shown is wound upon reel 94 with both its leading end 104 and its trailing end 106 projecting from the reel between and retained by the resilient reel lips 98, 100. For purposes of the present invention, only one wire end need project from the reel. Projection of both ends facilitates prior processing of the wire after it has been wound on the reel, including stripping of wire ends and attachment of both terminal pins. The reel is loaded into the magazine or reel chamber defined by walls 88, 90 with its leading end 104 (FIG. 5) projecting downwardly into a guide chute having sides 105, 107 formed by curved bottom portions of the chamber. The reel rests and rotates on the chamber bottom portions 108 as wire is withdrawn from the reel.

In the bottom portion of the reel chamber is a pair of juxtaposed friction rollers, such as roller brushes 110, 112, mounted for oppositely directed rotation about parallel axes. The roller brushes grasp the leading terminal pin 46 and wire end 104 and drive it downwardly through an aperture 114 in the working head bottom plate 84 and through a guide 114*a* fixed to and depending from the bottom plate. The wire withdrawal brushes 110, 112 are driven by a belt 109 and a motor 111 carried on the working head. The reel is manually loaded into the working head chamber and positioned so that the protruding leading end 104 of the wire is grasped by the rotating withdrawal rollers 110, 112. Alternatively, if deemed necessary or desirable, a number of wire bearing reels such as reel 94 may be loaded in a reel storage device (not shown) and removed therefrom one at a time by automatic means for automatic insertion into the reel receiving chamber of the working head 51.

Figure 10:
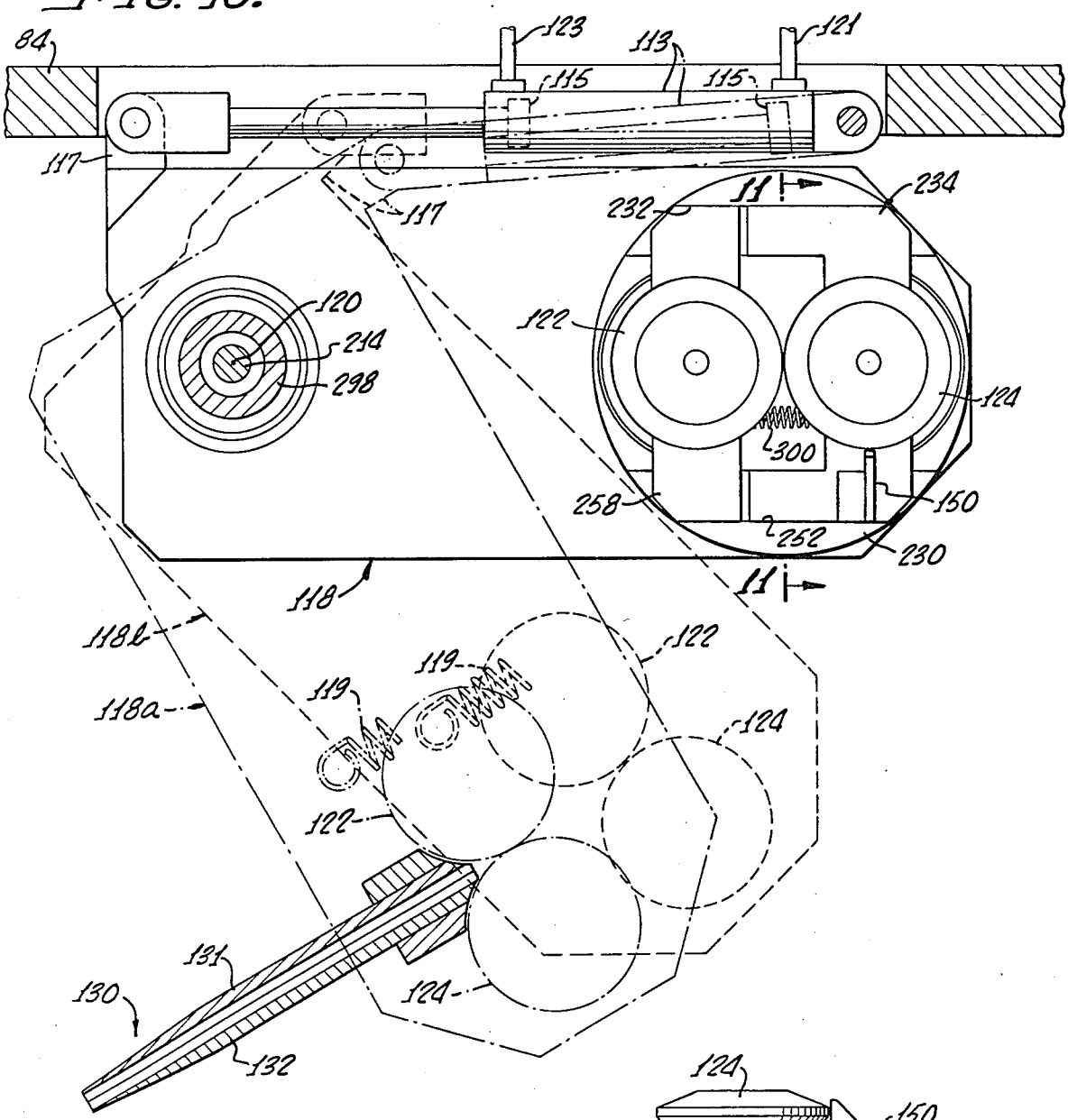
FIG. 10 is a side view of the swing arm and pinch rollers.
Figure 11:
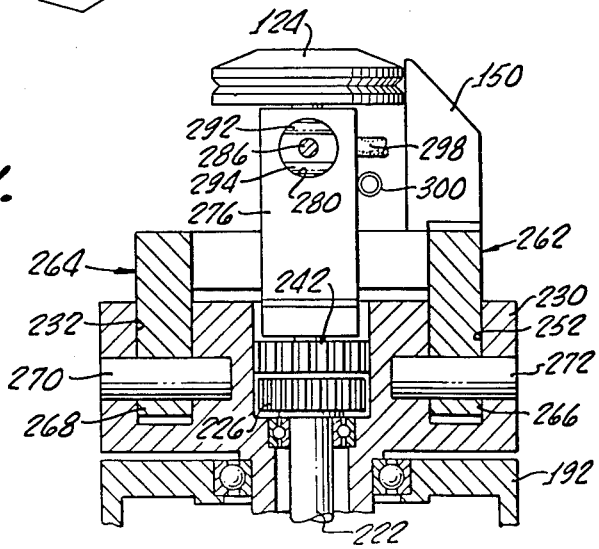
FIG. 11 is a section taken on lines 11—11 of FIG. 10.

A fixed bracket 116 is suspended from the bottom of lower working head plate 84 and mounts a wire drive or swing arm 118 for pivotal motion about a substantially horizontal axis 120. As best seen in FIG. 10, the swing arm is driven by a double acting air motor 113 pivoted at one end to lower working head plate 84 and having a piston 115 pivotally connected to a drive extension 117 on the swing arm. A tension spring 119 is connected between an intermediate portion of the swing arm and plate 84. Air pressure applied solely to one side of the piston via an air hose 121 swings the arm 118 counterclockwise (as viewed in FIG. 10) to its solid line position. Air pressure applied solely to the other side of the piston via an air hose 123 swings the arm clockwise to the phantom line (extreme clockwise) position 118*a* shown in FIG. 10. Absence of applied pressure to both sides of the piston allows the spring 119 to hold the swing arm in an intermediate position 118*b* illustrated in dotted lines. The free end of swing arm 118 carries a pair of juxtaposed pinch rollers 122, 124 that can be driven about mutually parallel spaced axes by a mechanism to be described below. The rollers may be separated from one another by a first relatively small amount that allows the rollers to slide freely along but still retain a grasp of a wire interposed therebetween, and by a second larger amount that allows a terminal pin and its enlarged shoulder to be inserted along the length of the pin between the rollers. The rollers are spring urged toward one another to firmly grasp and pinch either the rear section of a terminal pin or a wire interposed between the two.

Figure 5:
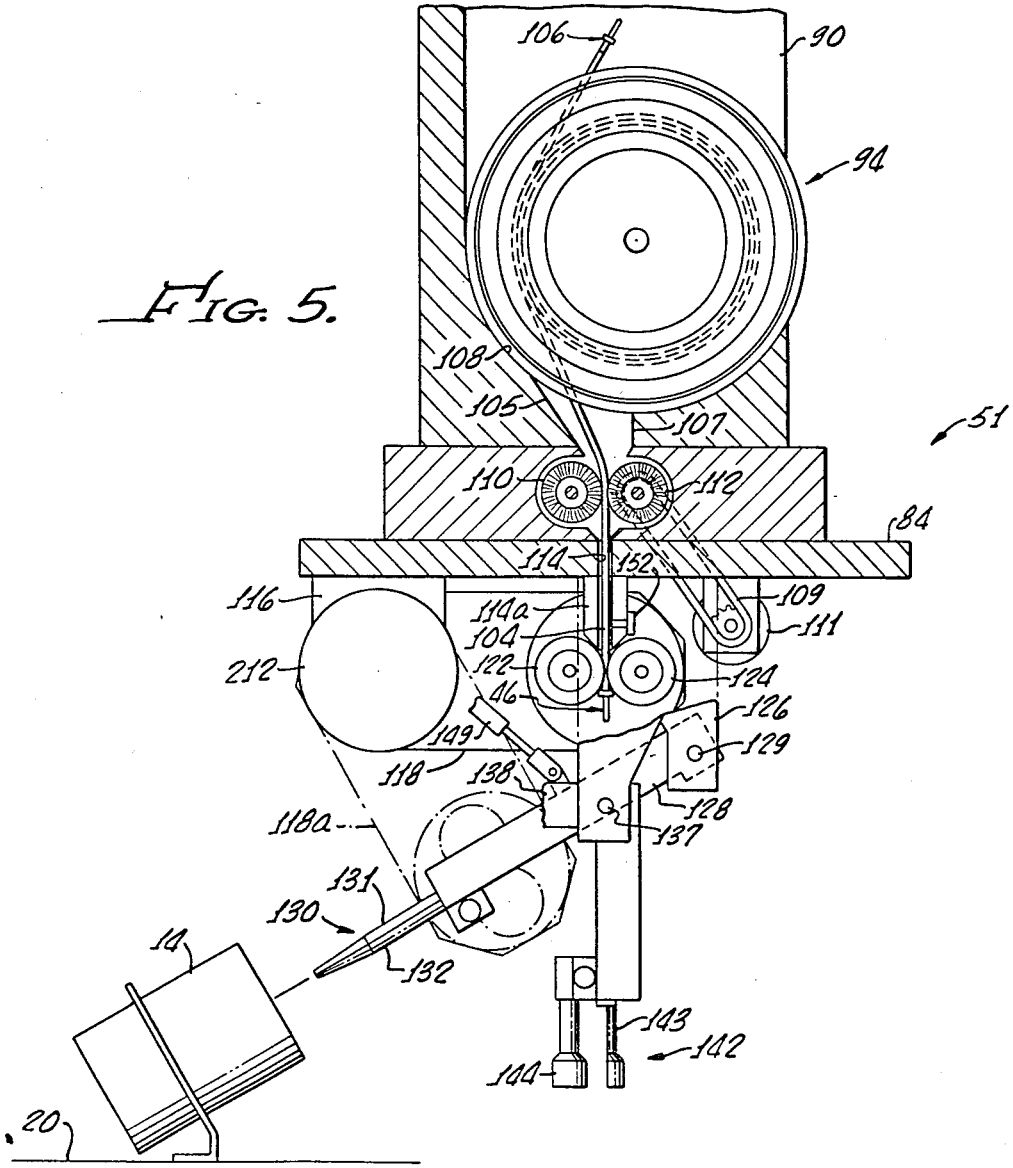
FIG. 5 is a sectional view of a working head of an apparatus embodying the principles of the present invention.

The swing arm pivot and pinch rollers are positioned so that when the swing arm 118 is in its uppermost position, as illustrated in solid lines in FIG. 5, a wire end 104 that is driven downwardly from the reel chamber 86 through aperture 114 and guide 114*a* will follow a path substantially along the common tangent of the rollers so that the leading end terminal pin 46 on the wire end will be received by and between the pinch rollers 122, 124.

Figure 6:
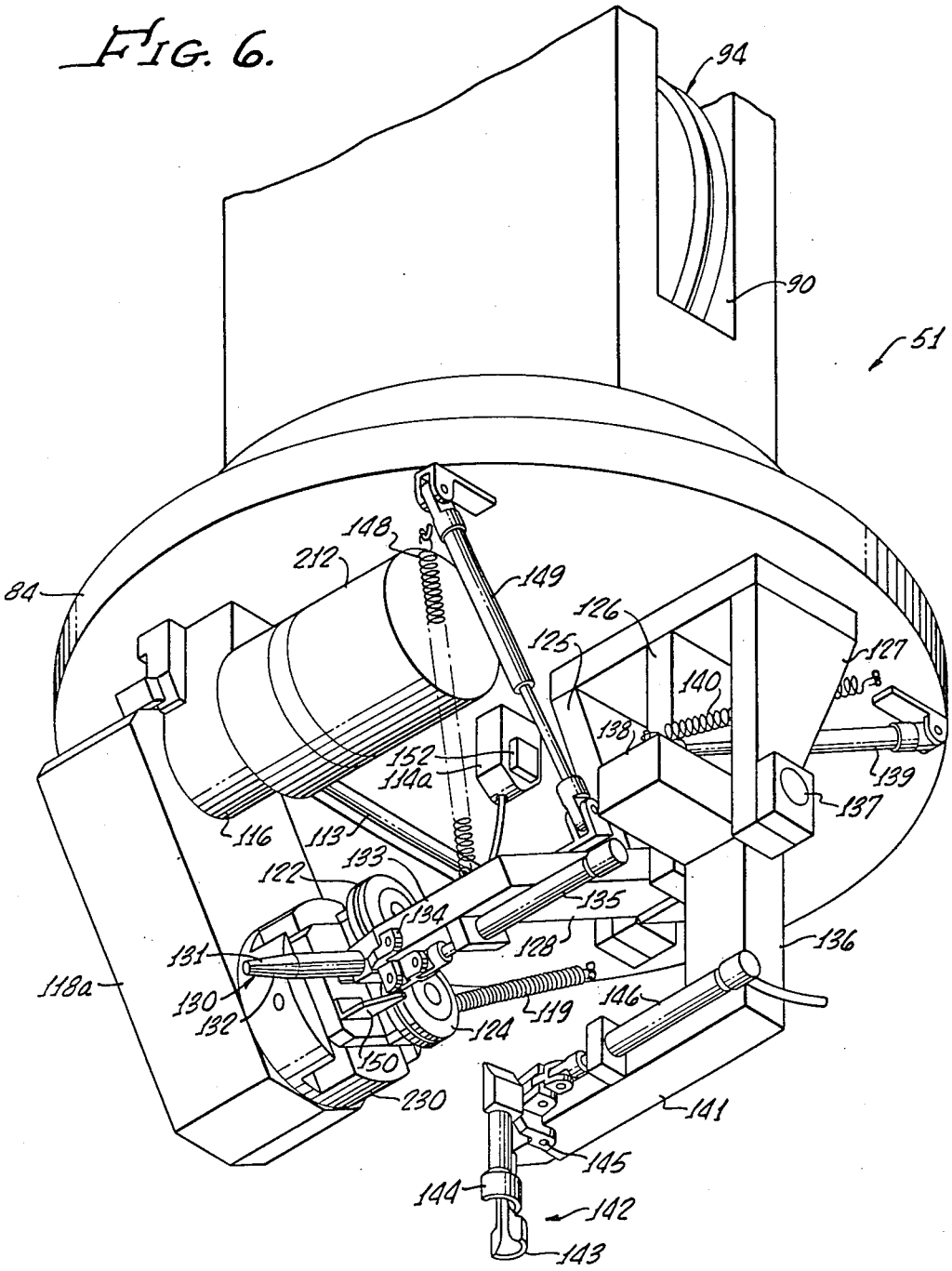
FIG. 6 is a perspective view of the head of FIG. 5.
Figure 6A:
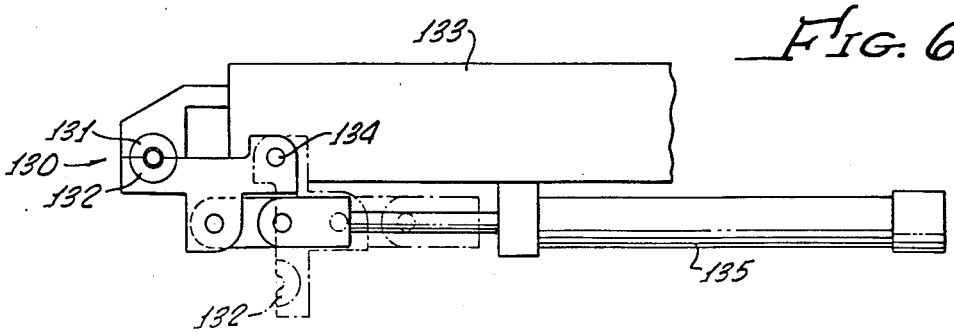
FIG. 6*a* shows details of the quill opening and closing arrangement.
Figure 6B:
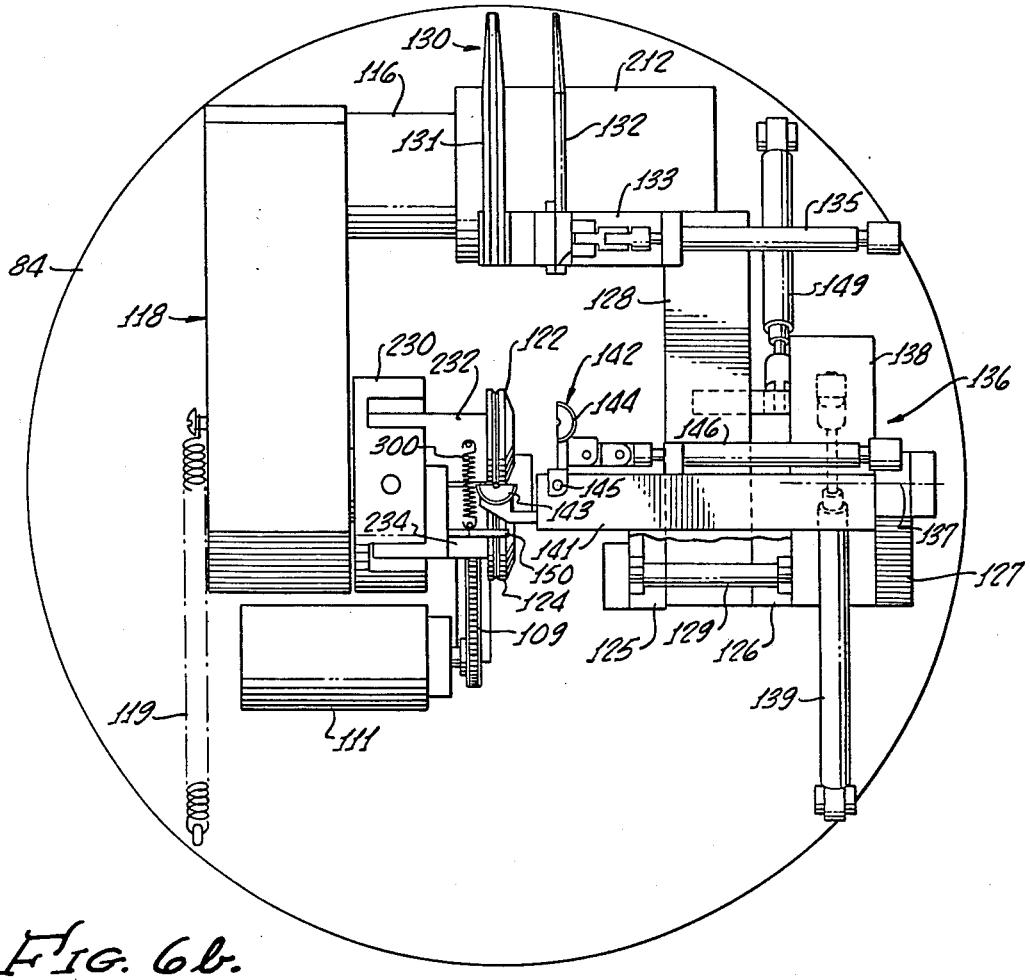
FIG. 6*b* is a plan view of the bottom of the working head.
Figure 7N:
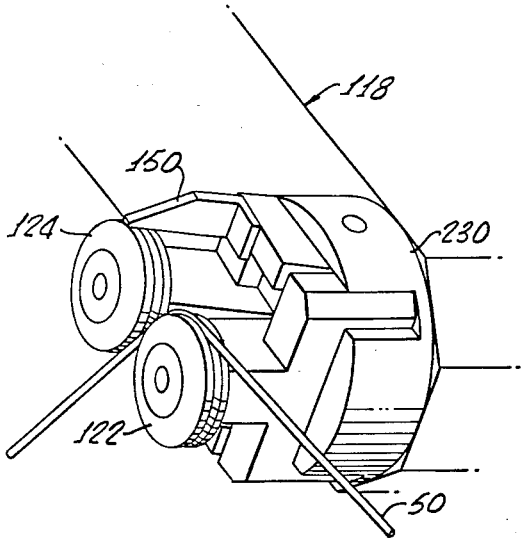
FIGS. 7*n* and 7*o* illustrate a wedge for removal of the wire from the rollers after insertion of the second terminal pin.
Figure 7O:
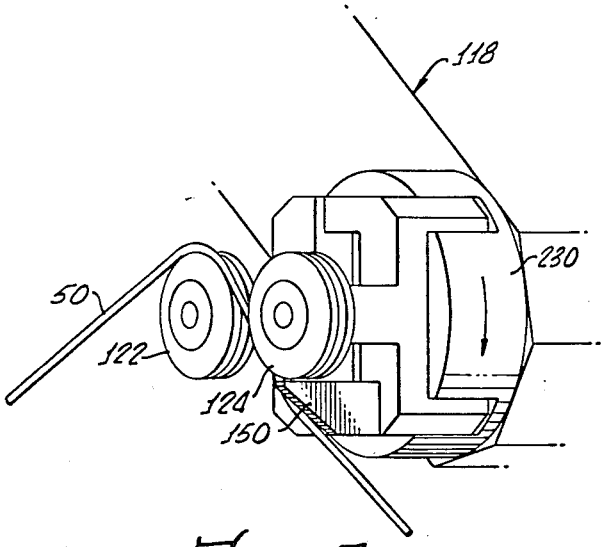
Figure 7C:
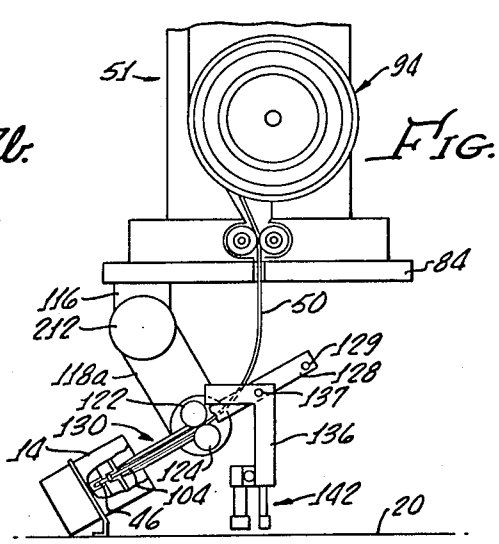
FIGS. 7*a* through 7*m* are schematic illustrations of a sequence of operations carried out by the head of FIGS. 5, and 6 during harness assembly.
Figure 7B:
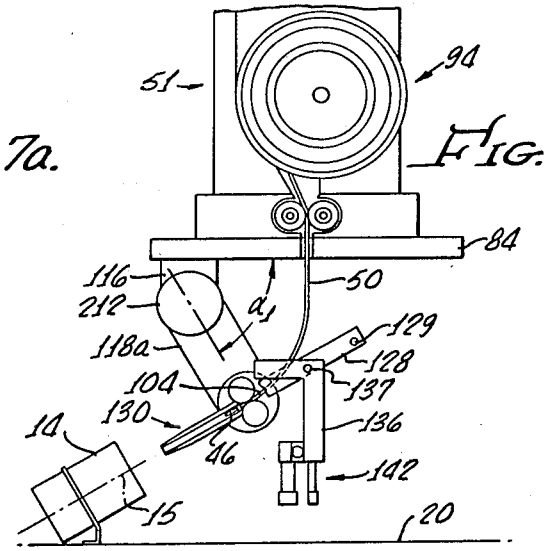
Figure 7A:
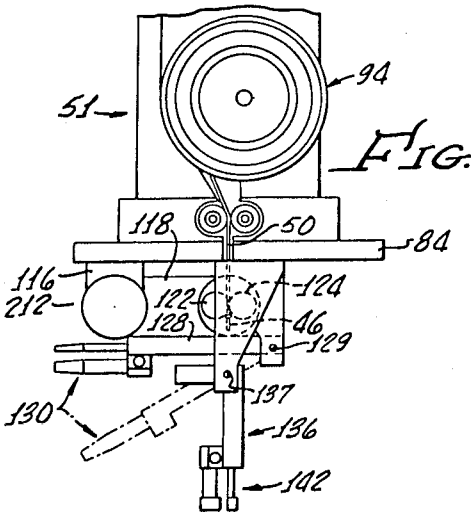
Figure 7F:
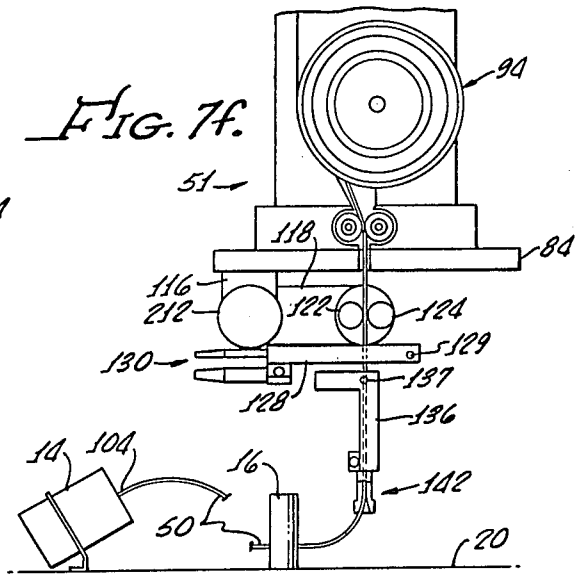

Fixed to and depending from the lower plate 84 is a bracket having mutually spaced parallel depending arms 125, 126, 127 (FIGS. 6, 6*b*). An L-shaped quill insertion arm 128 is mounted between arms 125, 126 for pivotal motion about a first horizontal axis 129. Arm 128 carries a split insertion quill 130 having a relatively fixed upper section 131 and a lower section 132 that is pivoted to a transverse leg 133 about an axis 134 parallel to the longitudinal extent of the arm and driven by an air motor 135 to and from a closed position (FIGS. 2 and 6) wherein the two quill halves are adjoining to form a protective sheath that fully encloses a terminal pin. Upon retraction of the piston rod of air motor 135, the lower quill section 132 swings downwardly to an open position (FIGS. 6*a*, 6*b*) sufficiently displaced to clear a pin or wire grasped between rollers 122 and 124 when the open quill and its support arm 128 are pivoted about axis 129 in a counterclockwise direction from an upper position (shown in FIG. 7*a*). Support arm 128 is held in its upper position by a tension spring 148 connected between plate 84 and an intermediate portion of the arm. An air motor 149, pivotally connected between plate 84 and an intermediate portion of support arm 128, is extended to pivot the arm downwardly to operative position. As can be seen in FIG. 2, the quill parts, when in closed position, provide a pin and wire end receiving bore that has a tapered rear portion 147 and a cylindrical forward portion 148 that closely slidably receives the pin shoulder 47. The enlarged and slightly tapered rear portion 147 of the quill bore facilitates insertion of the pin into this end of the closed quill.

Figure 7E:
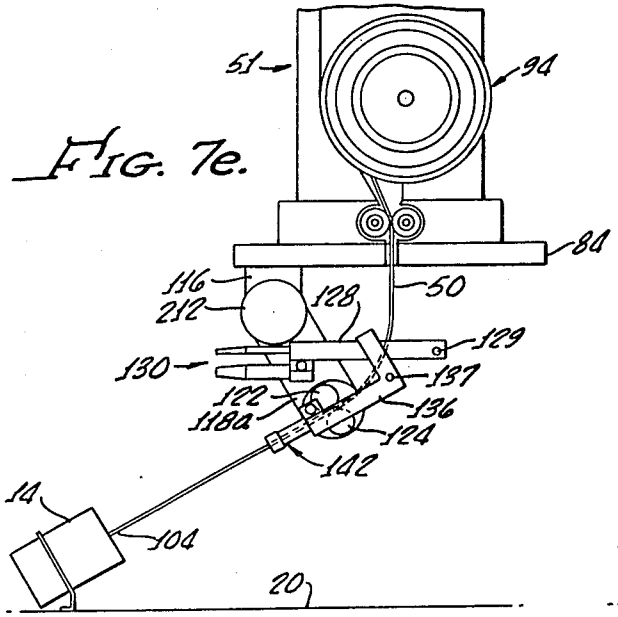
Figure 7D:
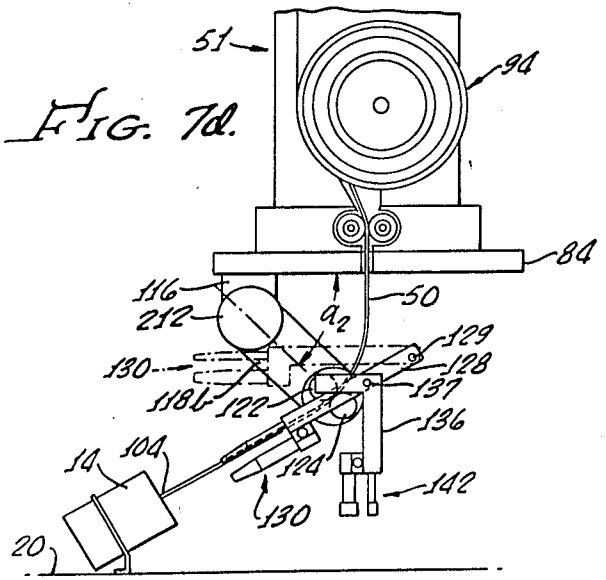
Figure 7J:
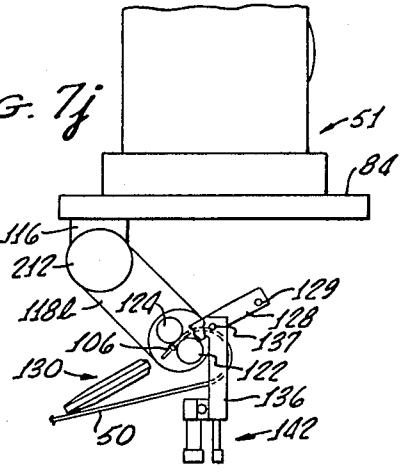
Figure 7I:
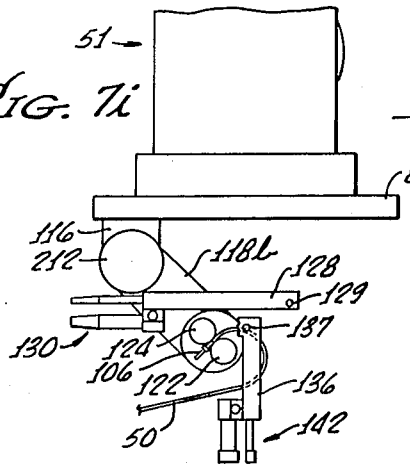
Figure 7H:
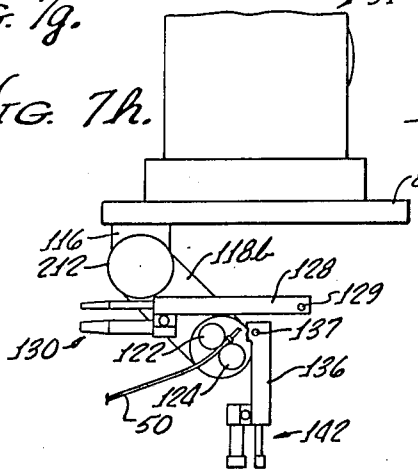
Figure 7G:
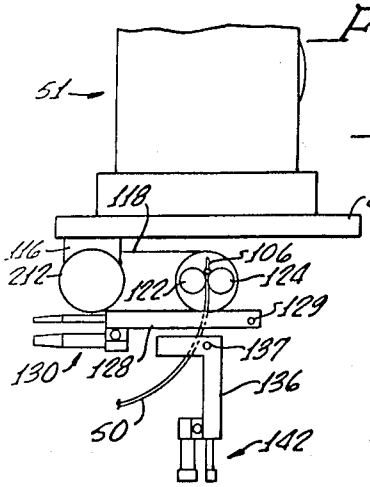
Figure 7M:
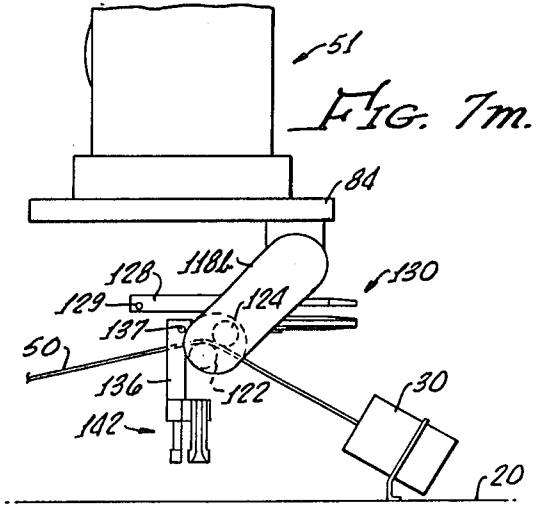
Figure 7L:
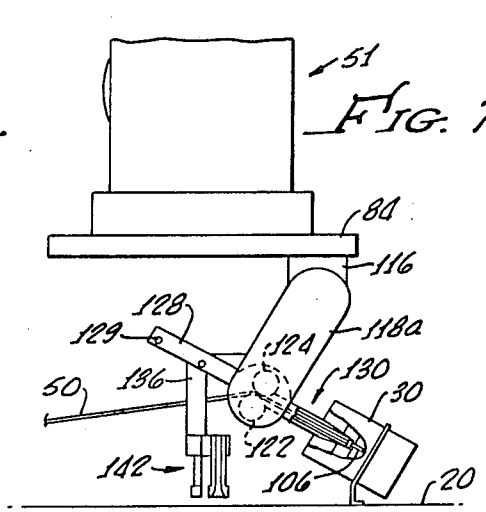
Figure 7K:
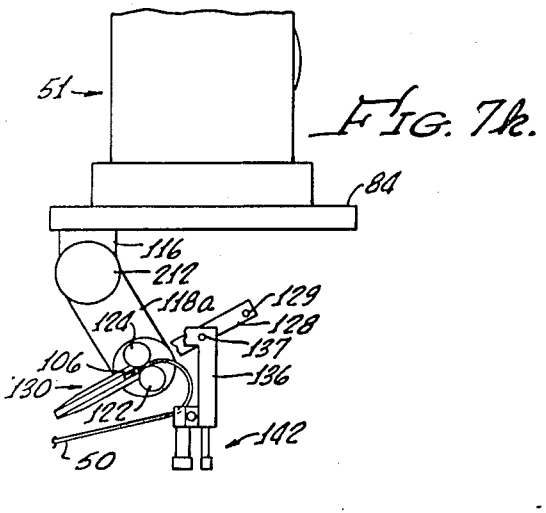

A nozzle support arm in the form of a bell crank 136 is mounted between bracket arms 126, 127 for pivotal motion about a substantially horizontal axis 137 that is displaced from the quill arm axis 129 (FIG. 5). Extending from one side of pivot 137, the bell crank carries a drive leg 138 to which is pivoted the piston rod of an air motor 139 that is pivoted at its other end to the plate 84. A nozzle support arm tension spring 140 is connected between drive leg 138 and plate 84 to swing the free end of the arm upwardly for grasping a wire as will be described below. Extension of the air motor piston rod drives the bell crank in a counterclockwise direction (as viewed in FIG. 5). Mounted to a transverse leg 141 fixed to the end of arm 136 is a routing nozzle 142 having a fixed lower half 143 and a movable upper half 144 pivoted to transverse leg 141 about an axis 145 substantially parallel to the longitudinal extent of the arm. The split nozzle parts may be closed to provide a routing guide bore of relatively large diameter through which a wire may freely travel as the nozzle is moved along the length of the wire. Movable nozzle half 144 can be pivoted relative to the fixed half 143 so as to clear a wire grasped between the pinch rollers 122, 124 as the nozzle and its support arm 136 are swung about pivot 137 in a clockwise direction to the position shown in FIG. 7*e*. Movable nozzle half 144 is actuated by an air motor 146 carried by transverse 141 and having a piston rod pivoted to the movable nozzle half.

METHOD OF INSERTION AND ROUTING

FIGS. 7*a* through 7*m* are diagrammatic illustrations of successive steps in one method of terminal insertion and routing that can be carried out with the described apparatus. A reel having a routing wire with terminal pins on both ends is loaded into the insertion head chamber, as previously described, so that the leading end of the wire is driven by the withdrawal rollers 110, 112 to and between the partially opened and rotating pinch rollers 122, 124. In partially open position, the entire terminal pin, including shoulder 47, can pass longitudinally between the rotating rollers. During this initial portion of the operation, the swing arm 118 is in its uppermost or wire loading position, being horizontally directed in FIGS. 5 and 10 (solid lines) and in FIG. 7*a*. Both the nozzle 136 and insertion quill 130 are initially swung to the positions shown in FIG. 7*a* in solid lines. An optical sensor 152 on the swing arm 118 transmits light and receives an enhanced reflection from the terminal pin to detect approach of the pin to the rollers. The brush motor drive is then slowed and the pin passes between and slightly beyond the rollers, where the forward wire motion is stopped. The partially open rollers are now stopped and closed on the wire, driven in a forward direction to be certain that the terminal pin has passed, and then driven in reverse to pull the pin back toward the rollers which have electrically conductive surfaces connected in a signaling circuit. Thus, a signal is provided when the rear of the terminal pin is pulled to and between the rollers. The roller drive is stopped, and roller rotational position, as indicated by a roller rotation position encoder (not shown), is noted or "zeroed". Alternatively, roller rotational position is determined and stored as the number of drive pulses that are fed to the step motor 212 that drives the rollers (as described below). With the rollers closed to firmly grasp the rear section of the pin (as shown in FIGS. 5 and *7a*), the carriage and the insertion head are traversed in X, Y and Z directions until the working head is close to but spaced from the connector into which the first terminal at the first end of the wire is to be inserted.

The connector axis, which is parallel to the several mutually parallel axes of the many pin receiving apertures in the connector, extends at an upward angle to the horizontal surface of the table. If the connector axis is horizontal, there may be interference with motion of the head for insertion of a terminal because the motion, in such case, must be parallel to and close to the table surface where interferring devices such as other wires of the cable harness, guide posts, and other connectors may be present. If the connector axis, on the other hand, is at 90° to the horizontal, a terminal pin may be inserted straight downwardly without interference with the harness or guide pins, but, in such a case, the entire bundle of harness wires, which lies in a substantially horizontal plane, will bend 90° relative to the connector face. Such a bend is difficult because of the stiffness of a large, closely packed, high density bundle of wires and, moreover, will result in a significant change in length of wire between connectors. Accordingly, an intermediate angle is preferred in order to minimize interference with head motion and also to minimize the angle of bend required of the wires at the counter face. As presently preferred, all connectors are fixedly positioned so that the connector axis extends at approximately 30° to the plane of the table (FIGS. *7b–7f*), although any angle may be employed. However, if any connector is mounted above the table, its axis may be horizontal because the problem of interference with devices at or near the table surface is minimized or eliminated.

As described above, the rollers are closed to firmly and rigidly grasp the rear portion of the pin, with the forward portion of the pin projecting tangentially from between the rollers. Air motor 149 is actuated and quill arm 128 is swung downwardly, in a counterclockwise direction, from the solid line to the dotted line position of FIG. *7a* until the insertion quill axis is positioned along a line parallel to the connector axis 15 which makes a 30° angle with respect to the horizontal. The quill halves 131 and 132 are closed by extension of air motor 135, and double acting air motor 113 is actuated via air hose 123. This retracts the motor piston, and the swing arm 118 is pivoted downwardly about its pivot axis 120 to a second or quill load position (FIG. *7b* and position 118*a* of FIG. 10) wherein the common tangent to the two rollers is aligned with the axis of the insertion quill. The angle between the axis of the swing arm and the plane of the bottom of insertive head plate 84 in this position is denoted by $\alpha_1$. As the swing arm pivots to this position, the forward projecting portion of the pin 46 is inserted into the rear portion of the closed quill. The rear end of the quill has its curved surfaces positioned substantially against and in mating relation with the two closed pinch rollers 122, 124 (as best seen in FIG. 2).

Now the entire head is moved in X, Y and Z coordinates and rotated about the C axis so as to move the quill and roller combination as a unit. During this motion, the first terminal pin is rigidly held between the rollers and protected by the enclosing quill halves. The head moves downwardly along the connector axis 15, to the position shown in FIG. *7c*, until the forward end of the insertion quill enters the appropriate grommet aperture so that the forward end of the quill is at or substantially at the bottom of the tapered camming entrance portion 37 (see FIG. 2) of the grommet aperture. With the connector fixed in position, and the position of its several apertures known, the line of motion of the insertion head, carrying the quill and roller assembly, is directed to align the pin with the aperture 38 (FIG. 2) of the connector retainer plate. If the aperture 40 of the grommet has been displaced or distorted in some manner so that it is no longer aligned with its associated retainer plate aperture, the motion of the insertion quill forward end, as it approaches the entrance portion 37 of the grommet aperture, causes the forward end of the quill to engage the sides of the grommet entrance aperture. This cams the grommet so that the grommet aperture 40 is forced into alignment with the quill and thus is moved to alignment with the retainer plate aperture 38.

When the insertion quill has entered the grommet aperture, (e.g., partially entered the connector) and is in the position of FIG. *7c*, motion of the entire head for quill insertion is terminated and the pinch rollers 122, 124 are driven in mutually opposite directions by roller drive step motor 212 (FIG. 5) so that the pin is driven from the rollers and further into the insertion quill (FIG. 2). Distance traveled by the pin from the rollers is measured as by monitoring pinch roller rotation, for example. The spring urged rollers grip the wire 50 adjacent the rear end of the pin and continue to frictionally drive the wire, thereby further driving both wire and terminal through the insertion quill. The pinch roller drive is continued for a predetermined distance which is sufficient to move the terminal pin from the pinch rollers to the dotted line position illustrated in FIG. 2, in which position the terminal pin has been properly inserted into the connector and locked in place in the connector by resilient connector fingers 172, 174 as is well known in the art.

With the terminal pin inserted, attainment of the proper position of the terminal pin within the connector can be readily tested by any one of several arrangements. For example, the rollers may be driven in reverse with a relatively low torque applied (a torque of about seven pounds) since a proper connection of the terminal will resist a pull of more than ten pounds. If the pin is withdrawn under a torque of seven pounds or less, it is known that the connection is not adequate and the pin will have to be reinserted. If the test is provided by reversing direction of the rollers, the tension thus applied to the now connected wire and terminal pin will produce a strain on the swing arm 118, which may be measured by a strain gauge. As an alternative method of testing, the swing arm 118 may be powered in a counterclockwise direction from the position of FIG. *7c* with a predetermined test torque that applies to the pin a withdrawal pull of seven pounds.

After the pull test has been satisfactorily completed, the rollers are spread apart to a first or partially open position, in which the wire is free to slide between the rollers, but in which the space between the rollers is too small to allow the pin and its shoulder to slide between the rollers. The wire remains loosely captured between the rollers. The entire head is then retracted to a position spaced several inches from the connector, allowing the now connected wire, of which the one end remains secured to the fixedly positioned connector 14, to slide through the insertion quill and between the rollers. Swing arm 118, which had been positioned at the angle $\alpha_1$ in the operations described in connection with FIGS. *7b* and *7c*, is now retracted from the quill load or second position to an intermediate or third position (FIG. *7d*) in which the axis of the swing arm 118 makes an angle $\alpha_2$ with the plate 82, where $\alpha_2$ is smaller than $\alpha_1$. This third position, illustrated in dotted lines as **118*b* in FIG. 10, is achieved under control of spring 119, with both sides of the double-acting air motor 113 depressurized. This displaces the rollers from the rearward end of the quill so that the two halves of the insertion quill may be swung open by retraction of the piston rod of air motor 135. Pressure is then applied to air motor 113 via hose 121** to pivot the quill arm counterclockwise to the out of the way position illustrated in dotted lines in FIG. *7f*.

With the insertion quill in out of the way position, and the swing arm in its intermediate position at the angle $\alpha_2$, air motor 139 is depressurized to allow spring 140 to swing nozzle arm 136 in a counterclockwise direction to move nozzle 142 into a position (FIG. *7e*) aligned with wire 50, which now extends from the rollers to the connector 14. The movable half 144 of the nozzle, which is in open position as it moves into the position of FIG. *7e*, is pivoted, by extension of air motor 146, to close the two nozzle halves about a portion of the wire extending between the pinch rollers and the connector 14. Now the swing arm 118 is pivoted counterclockwise to its first or out of the way position, as shown in FIG. *7f*, and air motor 139 is pressurized to swing the nozzle arm 136 counterclockwise to a substantially vertical position (shown in FIG. *7f*) to provide a nearly vertical path for wire 50 from the reel 94 in the insertion head chamber, between the partly open rollers 122, 124, and thence to and through the routing nozzle 142 to its end connection at terminal 14.

With the parts in the position illustrated in FIG. *7f*, the entire head is moved as desired in X and Y directions so as to route the wire 50 along a desired horizontal path across harness table 20 and around the various routing pins, such as pin 16 (FIG. 1). The head is moved toward the second connector, to which the second end of the wire 50 is to be attached. During this traversing motion, all movable parts of the head, other than the routing nozzle 142, are in withdrawn position to minimize interference with the traverse. As the head traverses, the motion of the routing nozzle pulls wire (which has one end fixed to connector 14) from the reel 94. The wire is guided through the nozzle and over a rounded edge or roller (not shown) mounted thereon. If deemed necesssary or desirable, the nozzle may be castered so as to pivot about a vertical axis and maintain alignment of the axis of any roller or the nozzle across the length of the wire which is being drawn through the nozzle. The wire remains captured between but freely slidable along the partly open rollers 122, 124 during traverse of the head.

As the insertion head nears the end of its traverse and begins to approach the second connector, its motion is slowed, sensor 152 detects approach of the second terminal pin 106 to the partly open rollers 122, 124 and motion of the head is stopped. The rollers are closed and driven forwardly to pull the second pin to the rollers (FIG. *7g*). When the shoulder of the second pin contacts both rollers, an electrical circuit is completed, as previously described, to provide a signal upon occurrence of which the roller rotation position is again noted or "zeroed" (or count of roller drive pulses to step motor 112 is begun).

Now the swing arm is moved down to its intermediate position ($\alpha_2$ position), as shown in FIG. *7h*, and the two rollers together are rotated 180° (in a counterclockwise direction as viewed in FIG. *7h*) about an axis parallel to the roller axes and passing through the point of common tangency of the rollers. Upon completion of this 180° rotation, the parts are in the position illustrated in FIG. *7i*. Now the routing nozzle halves are separated to allow the wire to be withdrawn from the nozzle upon further motion of the head or swing arm. With the swing arm in its intermediate position, as illustrated in FIG. *7j*, the quill 130 then (or at some earlier step of the operation, to save time) is swung counterclockwise to its insertion position in which the axis of the quill is at the same angle to the horizontal as the axis of the second connector. Because the swing arm is now in its intermediate position, the rollers 122, 124 are slightly spaced from the rearward end of the quill. Further clockwise motion of the swing arm 118 to the quill load position, illustrated in FIG. *7k*, inserts the second pin 106, still rigidly grasped between the now tightly closed rollers, partly into the insertion quill. Now the entire insertion head may be moved, as necessary or desirable, to position it close to and ready for insertion of the quill into the second connector, such as connector 30. The entire insertion head may be rotated about the C axis (as required by orientation of the second connector) so that the insertion quill, which is contiguous to the now rotated rollers, has its axis aligned with the axis of the selected aperture of the connector. FIGS. *7l* and *7m* show the entire head rotated a full 180° (as an example).

Now steps described above in connection with insertion of the first pin are repeated. The entire insertion head is moved along the axis of the connector aperture to partially insert the quill into the grommet aperture, aligning the grommet aperture with the connector aperture, if necessary, as shown in FIG. *7l*. With the quill partly inserted into the grommet aperture and the second pin 106 still rigidly grasped between the rollers and enclosed by the insertion quill, the rollers are both driven in a direction opposite to the direction in which they are driven for insertion of the first terminal pin. This drives the second pin from between the rollers and through the insertion quill. The roller drive on the wire continues, as before, until the pin has reached its desired completely inserted position. A pull test is accomplished, as previously described, and, if successful, the entire head is retracted from the second connector, the swing arm is moved back to its intermediate ($\alpha_2$ position), and the insertion quill is opened and moved upwardly to an out of the way position. The rollers are opened to a full open position, and the two rollers are rotated 180° about an axis parallel to the roller axes and passing through their common tangent, being rotated back to their initial position. In the course of the second 180° rotation of the two rollers, the wire is pulled from between the fully opened rollers, and the apparatus is then ready to be positioned for handling of a second wire. If deemed necessary or desirable, a wedge-shaped wire lifter 150 (FIGS. *7n* and *7o*) is mounted on the rotatable roller housing to ensure removal of the wire from between the rollers as the rollers are rotated 180° back to their initial position. The now empty reel 94 is removed from the reel receiving chamber, and a second reel, carrying a second wire that has terminals connected to both of its ends, is inserted, as previously described, and the process is repeated for connection of the terminal pins on the ends of the second wire to the desired connectors.

It will be seen that once the first terminal pin is grasped by the pinch rollers, the rollers never leave the wire until insertion of the second terminal pin has been completed. The rollers merely slide along the wire from one end to the other, and the direction of their driving rotation is reversed to drive the second terminal pin.

WIRE AND SWING ARM CONSTRUCTION

As illustrated in FIGS. 8 through 12, swing arm 118 includes an arm housing having spaced side plates 190, 192 interconnected by end plates 194, 196 and journalled on a motor shaft housing 198 by means of bearings 200, 202. Shaft housing 198 is journalled on bracket 116 fixed to and depending from the bottom plate 84 of the insertion head 80 by means of bearings 206, 208. Shaft housing 198 is fixed to a motor housing 210 that mounts a step motor 212 that drives the pinch rollers 122, 124 by means of a motor shaft 214 running through and journalled in shaft housing 198 on bearings 197, 199. Shaft 214 has a drive sprocket 216 fixed to an end thereof. A drive chain 218 is entrained around sprocket 216 and extends to and is entrained around a second sprocket 220 fixed to a roller common drive shaft 222 that extends through and is journalled within a rotatable roller housing section 224 on bearings 219, 221. A sun gear 226 is fixed to the other end of shaft 222.

Roller housing section 224 is journalled in the swing arm structure on bearings 223, 225, and is fixedly connected to a common base section 230 which carriers a fixed roller housing section 232 and a pivoted roller housing section 234. Journalled in the housing sections 232 and 234 are roller drive shafts 236 and 238, respectively, carrying, at their inner ends, drive gears 240, 242, respectively, and at their outer ends carrying the rollers 122, 124, respectively. Gear 242 meshes with gear 240 which is fixedly connected with a common drive gear 246 which, in turn, is driven by engagement with sun gear 226.

Figure 12:
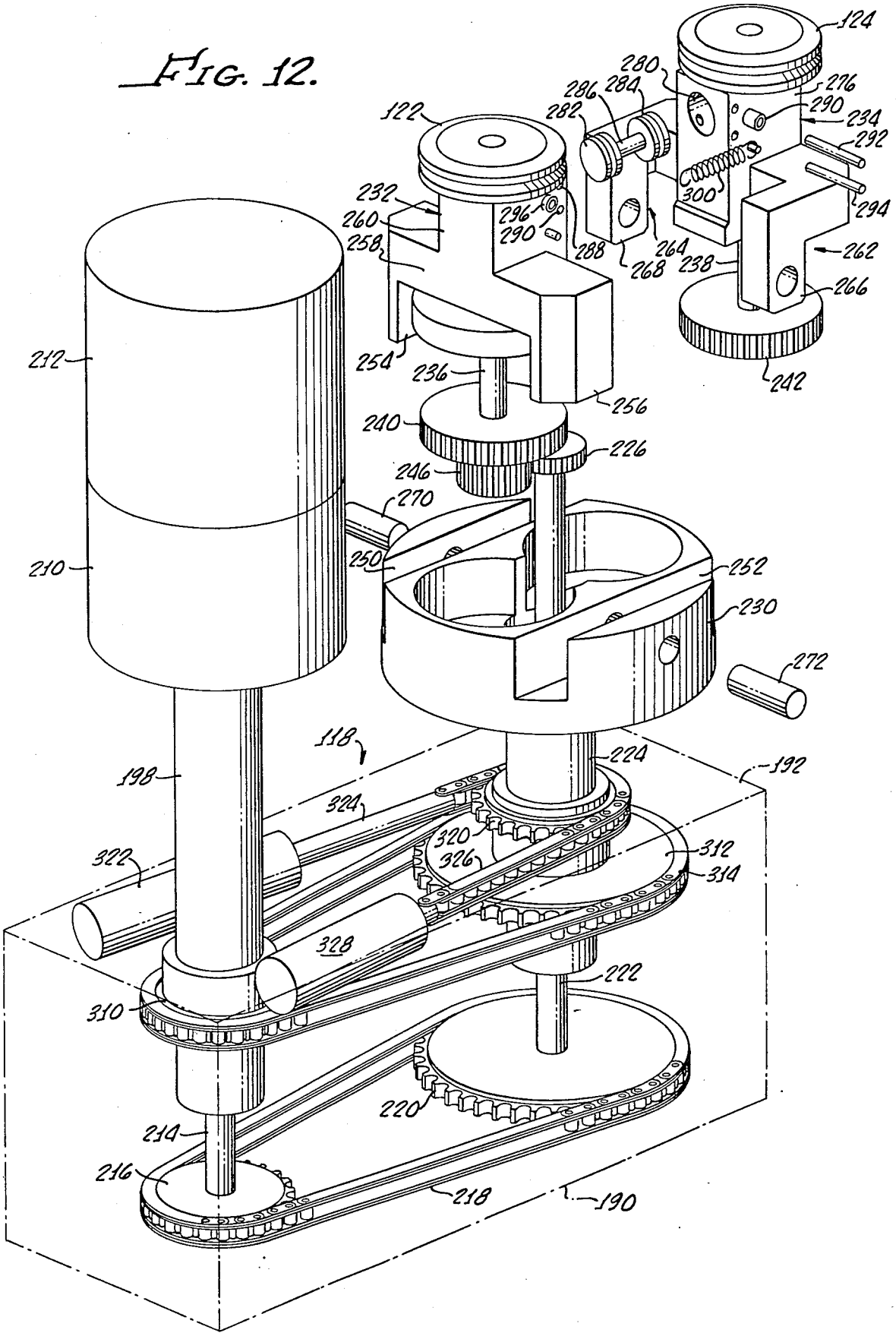
FIG. 12 is an exploded perspective view of the swing arm and pinch rollers of FIGS. 9-11.

As best seen in FIG. 12, common base section 230 is formed with a pair of spaced parallel transverse slots 250, 252, which respectively receive spaced legs 254, 256 of a transverse section 258 of the fixed housing section 232. A central upstanding section 260 of fixed housing section 232 is fixed to the section 258 and rotatably mounts roller shaft 236, to which roller 122 is fixed.

Pivoted housing section 234 has a pair of laterally spaced L-shaped legs 262, 264 each having an apertured ear 266, 268, respectively received in slots 252 and 250 of the common base section 230. Pivot pins 270, 272, fixed in the common base section 230, extend through the apertures of the respective ears 268, 266 and pivotally mount the housing section 234 to the common base 230. A central upstanding section 276 is fixed to the legs 262, 264, and journals the shaft 238 that fixedly carries roller 124. Central sections 260 and 276 of the two roller housings are formed with mating bores 278, 280 (see also FIG. 8) that respectively receive pistons 282, 284 that are rigidly interconnected by a common shaft 286. Stop pins 288, 290 in central section 260 and stop pins 292, 294 in central section 276 limit motion of each piston in a direction that tends to move the piston out of its associated bore. Air fittings 296, 298 admit air to the respective bores 278, 280 between the bottom of each bore and the outer face of each piston to thereby tend to drive each piston from its bore. Pressurized air is independently and separately applied to each of the fittings 296, 298 so that air applied to one of the fittings will move its piston relative to the housing section until the piston hits the stop pins, thereby mutually displacing the rollers by pivoting the housing section 276 about pins 270, 272. Air under pressure admitted to the other fitting will similarly drive the second piston, thereby causing a relative displacement of the two rollers that is independent of the first mentioned displacement. Accordingly, if air is applied to one of the fittings, the rollers will be displaced by a first amount according to the travel available to one of the pistons. If air is admitted to both of the fittings, the rollers will be displaced by a second and larger amount according the travel allowed to both of the pistons together. A tension spring 300 interconnects the two central sections 260 and 276 and urges the rollers firmly against one another so as to cause the rollers to grasp the pin or wire interposed therebetween in the absence of air admitted to either of the fittings 296, 298. Accordingly, the rollers may be mutually displaced by a first distance to allow the rollers to freely slide along a wire by admitting air to one of the fittings, and may be displaced by a greater distance to allow the larger terminal pin shoulder to pass between the rollers by admitting air to both of the fittings at the same time.

Shaft housing 198 has a second sprocket 310 affixed thereto and roller housing 224 has a sprocket 312 fixed thereto, the two sprockets being interconnected by a second chain 314 entrained over the sprockets.

Rotatable roller housing section 224 has a third fixed sprocket 320 affixed thereto and an air motor 322 (FIGS. 9, 12) fixed in the swing arm, has a piston driven shaft 324 of which an end is connected to a belt 326 entrained over sprocket 320 and having its opposite end connected to an air motor 328 also fixedly mounted within the swing arm 118. The air motors 322, 328 are actuated alternatively to rotate both rollers in unison, about the axis of shaft 222, relative to the swing arm.

Actuation of step motor 212 causes opposite direction rotation of both of the pinch rollers 122, 124 to thereby drive a pin or wire interposed between and grasped by the rollers, as previously described. Actuation of air motor 322 (while air motor 328 is not actuated) will retract the piston driven shaft 324 to rotate the sprocket 320. This rotation of sprocket 320 rotates the roller housing section 224, carrying all of the rotor housing with it to effect the previously described rotation of the rollers through 180° about an axis parallel to the roller axes and extending through their point of common tangency. Release of pressure in air motor 322 and actuation of air motor 328 rotates the sprocket and roller housing section 324 in the opposite direction, returning the roller housing section through 180° of rotation to the initial position.

It is desirable that longitudinal position of the wire and terminal relative to the rollers be known and controlled at all times. Thus, upon starting insertion of a first terminal, the first terminal pin is positioned precisely at and between the rollers. Knowing the starting position, a predetermined and precisely controlled amount of roller rotation drives the pin a known distance from the rollers and thus enables the pin to be driven from the position of FIG. 2, wherein the insertion quill is partly inserted into the grommet, with the pin still grapsed between the rollers, to the fully inserted position wherein the pin has been driven forwardly to the dotted line position of FIG. 2. Thus, the position of the pins on each end of the wire is known and controlled by applying a selected number of stepping drive pulses to the roller driving stepping motor 212 (or by a suitable encoder that tracks roller rotation). However, as the swing arm 118 is pivoted about the axis of shaft 214, sprocket 220 and common roller shaft 222 both rotate about the axis of shaft 214, causing the chain 218 to rotate sprocket 216 and thereby rotate the motor shaft 214. This rotation of motor shaft 214 will cause rotation of the rollers in the absence of any commanded driving by the stepping motor and must be avoided if precision control of wire end position is to be maintained by controlling the number of applied stepping drive pulses. Similarly, as the two rollers and their housing are rotated together 180° by operation of air motors 322 or 328, roller drive gear 246 revolves around sun gear 226, thereby again rotating the rollers. This, too, is a rotation that is not desired if open loop position control of the driven wire is to be maintained by controlling the number of applied pulses.

These undesired rotations are eliminated by the sprockets 310, 312 and chain 314. As the swing arm rotates about the axis of shaft 214, sprocket 312 also rotates about the same axis, thereby rotating sprocket 310 and housing 198. Rotation of housing 198 effects rotation of the housing of motor 212, and thus the undesired rotation of the shaft 214 is compensated by the concomitant rotation of motor housing 212.

Similarly, as the roller housing 224 is rotated about the axis of shaft 222, chain 314 effects rotation of housing 198 and the housing of motor 212, thereby effecting rotation of the motor that compensates for rotation of the rollers caused by revolution of gear 246 about sun gear 226. This compensatory rotation is achieved by the fact that the rotation of the motor housing 210 causes shaft 214 to rotate therewith and thereby effects a rotation of the rollers that compensates for roller rotation caused by the rotation of the roller housing. Sprockets 310, 312, chain 314, and air motors 322, 328 also operate to brake rotation of motor and motor shaft housings 210, 198 when shaft 214 is driven to rotate the rollers about the axes of roller shafts 236, 238.

Principles of the invention may be applied for machine insertion of only one terminal pin, on only one end of a wire, into a connector. A group of wires, each connected at only one end to a common connector may be transported to a harness assembly table where the wires will be routed to have the terminal pins on their free ends inserted into other connectors, manually or as otherwise desired. In such an application, the 180° rotation of the rollers is not needed and the insertion head structure may be simplified by eliminating those parts required for such rotation.

One or more or all of the several motors and actuators may be manually controlled in the described sequences. Preferably, a suitably programmed digital control computer, having feedback inputs from sensors on the apparatus, is employed to drive the motors and actuators at proper times and in proper sequences for carrying out the described operations.

Although the apparatus and method have been described in connection with insertion of terminal pins on both ends of a wire, it will be readily appreciated that principles of the invention are fully applicable for insertion of wires, each of which has a terminal only on one of its ends.

The foregoing detailed description is to be clearly understood as given by way of illustration and example only, the spirit and scope of this invention being limited solely by the appended claims.

What is claimed is:

1. Apparatus for inserting a wire terminal into a connector comprising:

a support, an insertion head mounted on the support, means for mounting a connector on the support, a wire drive member carried by the head for motion between a first position and a terminal insertion position, wire drive means mounted on said member, said wire drive means including means for grasping and longitudinally driving a wire having a terminal secured thereto, means for moving said member from said first position to said terminal insertion position so that the end of a wire grasped by said wire drive means is moved to a terminal insertion position, means for actuating said wire drive means to longitudinally drive a wire grasped thereby, and means for moving said insertion head relative to said support and toward and away from said connector mounting means so that said head and the end of a wire grasped by said wire drive means are moved from a position remote from the connector mounting means to a position adjacent the connector mounting means.

2. The apparatus of claim 1 wherein said wire drive means comprises a pair of wire drive rollers, means for urging said rollers toward one another to grasp a wire therebetween, wherein said means for actuating comprises means for rotating said rollers to longitudinally drive a wire grasped between the rollers, and means for longitudinally inserting a wire between said rollers when said member is in said first position.

3. The apparatus of claim 2, wherein said rollers are mounted for individual rotation about mutually spaced parallel axes, including means for rotating said rollers together about an axis parallel to the axes of the rollers, and means for driving said rollers in a reverse direction to longitudinally drive the second end of a wire grasped between the rollers from said rollers.

4. The apparatus of claim 1, including quill means mounted on said insertion head, means for moving the quill means relative to the support between a retracted position and a position adjacent said wire drive means when the latter is in said terminal insertion position, said quill means including a protective sleeve adapted to enclose a terminal attached to a wire grasped in said wire drive means, said means for moving said insertion head including means for moving said sleeve and wire drive means from a far position wherein both the sleeve and wire drive means are remote from the connector mounting means to a near position wherein the sleeve is adjacent the connector mounting means.

5. The apparatus of claim 4 wherein said sleeve has a first end adapted to be positioned adjacent said wire drive means and has a tapered end remote from said wire drive means, said sleeve comprising first and second longitudinally separable sleeve parts mounted for motion relative to each other between an open position mutually spaced from each other wherein the open sleeve may be moved to and from a position adjacent a wire grasped by said wire drive means and a closed position wherein the first and second sleeve parts define a closed sleeve having a terminal receiving bore.

6. The apparatus of claim 1, including a reel mounting device mounted on said insertion head, a wire reel mounted to said device, and wire withdrawal means for withdrawing wire from said reel and feeding the wire to said wire drive means.

7. The apparatus of claim 1, including routing nozzle means mounted on said insertion head, means for moving the routing nozzle means between a first position and a second position adjacent said wire drive means, said routing nozzle means including means for freely and slidably enclosing a wire held between the wire drive means, and wherein said means for moving said inserton head guides said routing nozzle and wire enclosed thereby along a predetermined routing path.

8. Apparatus for inserting a wire terminal into a connector comprising:

a support, connector mounting means on the support, a terminal insertion head mounted to the support, a split quill mounted to the terminal insertion head, means for moving the quill relative to the insertion head between an insertion position and a retracted position, said quill comprising a first quill part and a second quill part connected to the first quill part for motion between an open quill position and a closed quill position, said quill parts in said closed quill position defining a longitudinal bore, means mounted to said terminal insertion head for driving a wire longitudinally of said quill so that a terminal attached to the end of a driven wire and positioned within said quill bore is driven from the quill by driving the wire to which the terminal is attached, and means for driving said terminal insertion head relative to the support so that said quill is moved from a position remote from said connector mounting means to a position adjacent a connector in said connector mounting means.

9. The apparatus of claim 8 wherein said connector has a terminal receiving aperture, said aperture having an entrance, and wherein said quill in closed position defines a tapered forward end, said means for driving said terminal insertion head including means for inserting said quill partly into the connector aperture, and means for driving said terminal insertion head so that said quill is retracted from said aperture.

10. Apparatus for inserting a wire terminal into a connector comprising:

a support, means for mounting a connector on said support, a terminal insertion head mounted on the support, wire drive means carried by said terminal insertion head for longitudinally driving a wire having a terminal, protective quill means carried by said terminal insertion head for guiding and protecting a wire terminal, means for moving said terminal insertion head relative to said support so that said wire drive means and quill means move between a near position adjacent the connector mounted to the support and a far position remote from the connector, and means for actuating said wire drive means in said near position so that a wire is longitudinally driven through said protective quill means into said connector.

11. The apparatus of claim 10 wherein said connector has apertures for receiving terminals inserted along parallel aperture axes, and wherein the connector is mounted with its aperture axes inclined at an acute angle relative to the support.

12. The apparatus of claim 10 wherein said connector has a plurality of pin receiving apertures, a grommet on said connector having a plurality of apertures each nominally aligned with an individual one of the pin receiving apertures, said grommet being subject to displacement and distortion that disturbs alignment of its apertures with the pin receiving apertures, at least some of said grommet apertures having outwardly and forwardly tapered entrance portions selectively receiving an end of said insertion quill in said near position, so that a selected grommet aperture is cammed into alignment by insertion of said quill end.

13. The apparatus of claim 10, including nozzle means carried by said insertion head for guiding a wire along a routing path as the insertion head is moved relative to the support.

14. The apparatus of claim 10 wherein said quill means comprises a quill arm mounted to said terminal insertion head, means for moving the quill arm relative to the insertion head between a retracted position and a position adjacent said wire drive means, said quill means comprising a first quill part fixed to said quill arm and a second quill part connected to said quill arm, means for moving the second quill part relative to the quill arm between an open position in which the second quill part is displaced from the first quill part and a closed position in which the two quill parts adjoin one another to define an insertion quill bore for receiving and protecting a wire terminal.

15. The apparatus of claim 10 wherein said wire drive means comprises a support member, first and second drive rollers mounted to one end of said support member for grasping a wire therebetween, means for rotating said rollers to drive a wire grasped therebetween, means for connecting said support member to said terminal insertion head, means for moving said support member and both said rollers relative to said insertion head between a retracted position and an insertion position, said protective quill means comprising a quill support arm connected to said terminal insertion head so that it moves together with the insertion head, means for moving the quill support arm relative to the insertion head between a retracted position and an insertion position adjacent said drive rollers, a first quill part fixed to said quill arm, a second quill part connected to said quill arm, means for moving the second quill part relative to the quill arm between an open position displaced from said first quill part and a closed position adjacent said first quill part and defining therewith a terminal insertion bore.

16. The apparatus of claim 10, including a nozzle support arm carried by said terminal insertion head, nozzle means for guiding wire carried by said nozzle arm, said nozzle means comprising a first nozzle part fixed to said nozzle arm and a second nozzle part connected to said nozzle arm, means for moving said second nozzle part relative to said nozzle arm between an open position displaced from said first nozzle part and a closed position adjacent said first nozzle part and defining therewith a wire guiding bore.

17. The apparatus of claim 10 wherein said wire drive means comprises a support member mounted to said terminal insertion head, a pair of wire drive rollers carried by said member and means for rotating said rollers.

18. The apparatus of claim 17, including drive roller mounting means for carrying said rollers, means for connecting said drive roller mounting means to said support member for rotational motion, and means carried by the support member for rotating said roller mounting means relative to the support arm.

19. The apparatus of claim 17, including a wire reel chamber on said insertion head for rotatably mounting a reel of wire, means for moving said support member to a position adjacent said chamber and means for driving wire from a reel in said chamber to said wire drive rollers.

20. The apparatus of claim 10, including a reel of wire mounted on said terminal insertion head, wire facing feeding means on said terminal insertion head for withdrawing wire from said reel and for feeding wire to said wire drive means.

21. The apparatus of claim 10, including a carriage on the support, means for mounting the terminal insertion head on the carriage, said means for moving the terminal insertion head comprising means for moving the carriage relative to the support in three dimensions and toward and away from the connector.

22. Apparatus for inserting a wire terminal into a connector comprising:

a support, a roller housing mounted to the support for rotational motion about a first axis, and first and second juxtaposed rollers mounted to said housing for individual rotation about respective axes parallel to said first mentioned axis, said rollers being positioned relative to one another to grasp a wire or terminal therebetween, wherein said support comprises an insertion head, a swing arm mounted to said insertion head for pivotal motion about a motor drive axis, a roller drive motor mounted to said swing arm and having an output drive shaft on said motor drive axis, a common roller drive shaft journalled in said roller housing, means for rotating said common roller drive shaft in response to rotation of said motor drive shaft, and means for driving said rollers in opposite directions in response to rotation of said common roller drive shaft.

23. The apparatus of claim 22 wherein said means for rotating said common roller drive shaft comprises a first sprocket on said motor drive shaft, a second sprocket on said common roller drive shaft and an endless chain entrained over said sprockets, whereby pivotal motion of said swing arm about said motor drive axis tends to rotate said common roller drive shaft, and means responsive to pivotal motion of said swing arm about said motor drive axis for compensating rotation of said roller causes by pivotal motion of said swing arm.

24. The apparatus of claim 22, including means on said swing arm for rotating said roller housing about said common roller drive shaft.

25. The apparatus of claim 24 wherein rotation of said roller housing tends to effect rotation of said rollers, and including means responsive to rotation of said roller housing for rotating said motor to compensate for roller rotation caused by rotation of the roller housing.

26. Apparatus for inserting a wire terminal into a connector comprising:

a support, a roller housing mounted to the support for rotational motion about a first axis, first and second juxtaposed rollers mounted to said housing for individual rotation about respective axes parallel to said first mentioned axis, said rollers being positioned relative to one another to grasp a wire of terminal therebetween, means for urging said rollers toward one another, means for displacing said rollers from one another, and means for moving said support to cause said rollers to move a wire and terminal grasped therebetween when said rollers are urged toward one another, and to cause said rollers, when displaced from one another, to move along a wire positioned therebetween.

27. Apparatus for inserting a wire connected terminal into a connector comprising:

a support adapted to have a connector mounted thereto, an insertion head, means for mounting said head to the support for motion relative to a connector mounted on the support, a swing arm pivoted to said head, a motor housing journalled about a motor axis in said swing arm, a motor mounted to said housing and having a motor drive shaft on said axis, a roller housing journalled on said swing arm about a roller drive axis spaced from said motor axis, a common roller drive shaft journalled in said roller housing, a first sprocket on said motor drive shaft, a second sprocket on said common roller drive shaft, an endless chain entrained around said sprockets, first and second pinch rollers journalled in said roller housing on first and second roller shafts having first and second mutually spaced axes parallel to the axis of said common roller drive shaft, gear means for interconnecting said common roller drive shaft and said first and second roller shafts to rotate said rollers in mutually opposite directions in response to rotation of said common roller drive shaft, a third sprocket on said motor housing, a fourth sprocket on said roller housing, and a second endless chain entrained about said third and fourth sprockets.

28. The apparatus of claim 27, including means for rotating said roller housing relative to said swing arm.

29. The apparatus of claim 27 wherein said roller housing comprises a base section, a first roller housing section mounting said first roller shaft and fixed to said base section, and a second roller housing section mounting said second roller shaft and pivotally connected to said base section, means for urging said first and second roller housing sections towards each other, and means for driving said first and second roller housing sections away from each other.

30. Apparatus for inserting a wire terminal into a connector comprising:

a support, means for mounting a connector on the support, an insertion head mounted to the support, a wire positioning means carried by the head for motion between a first position and a terminal insertion position, wire holding means mounted on said wire positioning means for grasping a wire having a terminal secured thereto, means for moving said wire positioning means relative to the insertion head from said first position to said terminal insertion position so that a wire grasped by said wire holding means is moved to a terminal insertion position adjacent said connector, means for moving the insertion head together with (a) said wire positioning means, (b) said wire holding means and (c) a wire grasped thereby, relative to said support, so that a wire grasped by said wire holding means is moved with the holding means to a position adjacent the connector, and means for driving said holding means to insert the terminal of a wire grasped by said wire holding means into a connector.

31. The apparatus of claim 30, including a reel mounting device mounted on said insertion head, a wire reel mounted to said device, and adapted to carry a length of wire wound thereon, and wire withdrawal means for withdrawing wire from said reel and feeding the wire to said wire holding means when said wire positioning means is in said first position.

32. The apparatus of claim 30, including a carriage, means for mounting the carriage to the support for motion relative to the support in three dimensions, and means for mounting the insertion head on the carriage, said means for moving the insertion head comprising means for moving the carriage in three dimensions relative to the support.

33. The apparatus of claim 32 wherein said means for mounting the insertion head on the carriage includes means for pivotally connecting the insertion head to the carriage.

34. Apparatus for inserting a wire connected terminal into a connector comprising:

a support, a connector mounted on the support, a protective quill mounted to the support, said quill defining a longitudinal quill bore for receiving and guiding a wire connected to a terminal, so that a terminal attached to the end of a wire may be positioned in said quill bore and may be driven from the quill by driving the wire to which the terminal is attached, means for driving said quill relative to said support toward and away from a connector on the suppot so that a terminal received in the quill bore is moved to a position adjacent the connector while it is within the quill bore, and means mounted to the support for driving a wire connected to a terminal positioned in the quill bore so that the terminal is driven from the quill bore into a connector while the quill is at the connector.

35. The apparatus of claim 34 wherein said quill has means on a rear end portion for receiving a terminal inserted longitudinally into said quill bore from the rear of said quill.

36. The apparatus of claim 34 wherein said quill includes a first quill part and a second quill part connected to the first quill part, means for moving the quill parts relative to each other between an open quill position and a closed quill position, whereby a wire extending through said quill bore can be removed laterally from said quill in open quill position.

37. The apparatus of claim 34 wherein said connector has a receiving aperture, said aperture having an entrance, and wherein said quill defines a tapered forward end received within said entrance of the connector aperture when the quill is driven to the connector, said means for driving said quill including means for inserting said quill partly into the connector aperture.

38. The apparatus of claim 34 wherein said means for driving a wire comprises a pair of juxtaposed rollers mounted to the support adjacent the quill for motion with the quill relative to the support, and means for rotating said rollers to drive a wire grasped therebetween.

39. The apparatus of claim 34 wherein said connector includes a plurality of closely spaced wires connected thereto and forming a dense group of wires adjacent at least one unoccupied connector aperture, and wherein said means for driving said quill comprises means for driving the quill in three dimensions so that the quill with a terminal received therein is driven through said group of wires to said one connector aperture.

40. Apparatus for inserting a wire end into a connector aperture comprising:

a support, a connector means for mounting upon said support and said connector having an aperture, an insertion head mounted on the support, a pair of rollers mounted tangentially adjacent each other upon the head, a protective quill mounted upon the head with one end of the quill adjacent the rollers, means for moving the quill together with the rollers relative to the connector, means for moving said wire end relative to said rollers and quill to a position between the rollers and axially aligned with the protective quill, said means for moving the quill together with the rollers comprising means for driving the head toward and away from the connector so that the quill is moved from a position displaced from the connector aperture to a second position adjacent the connector, and means for rotating the rollers so that the terminal is driven from the quill into the connector aperture.

41. The apparatus of claim 40, including means for moving said rollers in unison toward the wire end in a direction longitudinally of the wire so that the wire end may be longitudinally inserted between the rollers.

42. Apparatus for inserting a wire terminal into a connector comprising:

a support, means for mounting a connector on the support, a working head, means for mounting the working head on the support for motion relative to the support in three dimensions, wire drive means mounted on the working head and including means for grasping a wire, means for moving the working head in three dimensions relative to the support so that the working head, the wire drive means and the end of a wire grasped by the wire drive means are moved in three dimensions relative to the support from a far position remote from the connector mounting means to a near position adjacent the connector mounting means, and means for actuating the wire drive means so that a wire grasped thereby in said near position is driven relative to said working head toward said connector mounting means and into an aperture of a connector on said connector mounting means.

43. The apparatus of clam 42, including means for longitudinally inserting a wire into said wire drive means when the working head is in said far position.

* * * * *

UNITED STATES PATENT AND TRADEMARK OFFICE

CERTIFICATE OF CORRECTION

PATENT NO. : 4,757,606

DATED : July 19, 1988

INVENTOR(S) : Homer L. Eaton

It is certified that error appears in the above-identified patent and that said Letters Patent is hereby corrected as shown below:

On page 1 of the patent, under section [73] the Assignee MTS VEKTRONICS CORPORATION should be deleted and the following inserted ---MTS SYSTEMS CORPORATION, EDEN PRAIRIE, MINNESOTA---.

Claim 20, (Column 17, line 31), delete the word "facing".

Signed and Sealed this

Thirty-first Day of January, 1989

*Attest:*

DONALD J. QUIGG

*Attesting Officer*

*Commissioner of Patents and Trademarks*